US009354013B2

(12) United States Patent
Hodgson

(10) Patent No.: US 9,354,013 B2
(45) Date of Patent: May 31, 2016

(54) MOTORIZED WEAPON GYROSCOPIC STABILIZER

(71) Applicant: Dale Albert Hodgson, Chardon, OH (US)

(72) Inventor: Dale Albert Hodgson, Chardon, OH (US)

( * ) Notice: Subject to any disclaimer, the term of this patent is extended or adjusted under 35 U.S.C. 154(b) by 0 days.

(21) Appl. No.: 14/844,103

(22) Filed: Sep. 3, 2015

(65) Prior Publication Data

US 2015/0377579 A1 Dec. 31, 2015

Related U.S. Application Data

(63) Continuation-in-part of application No. 13/738,186, filed on Jan. 10, 2013, now Pat. No. 9,146,068.

(60) Provisional application No. 61/585,267, filed on Jan. 11, 2012, provisional application No. 62/107,666, filed on Jan. 26, 2015.

(51) Int. Cl.

| | |
|---|---|
| ***F41G 5/16*** | (2006.01) |
| ***F41A 27/30*** | (2006.01) |
| ***F41A 21/30*** | (2006.01) |
| ***F41A 21/36*** | (2006.01) |
| ***F41G 1/32*** | (2006.01) |
| ***F41G 3/12*** | (2006.01) |
| ***F41G 5/00*** | (2006.01) |

(52) U.S. Cl.

CPC ..... *F41A 27/30* (2013.01); *F41A 21/30* (2013.01); *F41A 21/36* (2013.01); *F41G 1/32* (2013.01); *F41G 3/12* (2013.01); *F41G 5/00* (2013.01)

(58) Field of Classification Search

CPC ..... F41G 5/16

See application file for complete search history.

(56) References Cited

U.S. PATENT DOCUMENTS

| | | | | |
|---|---|---|---|---|
| 464,806 | A | 12/1891 | Tower | |
| 640,051 | A | 12/1899 | Tower | |
| 1,573,028 | A | 2/1926 | Bates | |
| 2,106,998 | A | 2/1938 | Fieux | |
| 2,356,189 | A * | 8/1944 | Tufts | F41G 5/00 235/404 |
| 2,405,052 | A | 7/1946 | Poitras et al. | |
| 2,472,944 | A | 6/1949 | Furer et al. | |
| 2,532,333 | A | 12/1950 | Rhyne | |
| 2,534,225 | A | 12/1950 | Brown | |
| 2,609,606 | A | 9/1952 | Draper et al. | |
| 2,679,192 | A | 5/1954 | Seeley et al. | |
| 2,845,737 | A | 8/1958 | Hoyer | |
| 2,938,435 | A | 5/1960 | Gille | |
| 3,034,116 | A | 5/1962 | Shelley | |
| 3,078,728 | A | 2/1963 | Schlesman | |
| 3,144,644 | A | 8/1964 | Getting | |
| 3,165,972 | A | 1/1965 | Cumbo | |
| 3,362,073 | A | 1/1968 | Hausenblas et al. | |
| 3,396,630 | A | 8/1968 | Hinterthur et al. | |
| 3,424,522 | A | 1/1969 | Call | |
| 3,489,057 | A | 1/1970 | Tonkin | |

(Continued)

*Primary Examiner* — Reginald Tillman, Jr.
(74) *Attorney, Agent, or Firm* — Fay Sharpe LLP

(57) ABSTRACT

A motorized weapon gyroscopic stabilizer which creates a stabilizing effect for single shot, semi-automatic, and fully automatic weapons. The rotating mass that generates the gyroscopic stabilizing effect can be the rotor of the motor. The motor is designed to allow the mass to rotate around the open core of the motorized weapon gyroscopic stabilizer. Because of its open core design the motorized weapon gyroscopic stabilizer allows the fired projectile to pass through it, or be mounted in line with the sighting mechanism allowing the target alignment—line of sight to pass through the motorized weapon gyroscopic stabilizer, or both.

16 Claims, 15 Drawing Sheets

(56) References Cited

U.S. PATENT DOCUMENTS

| | | | |
|---|---|---|---|
| 3,502,062 | A | 3/1970 | Shurts |
| 3,640,178 | A | 2/1972 | Chatham et al. |
| 3,664,199 | A | 5/1972 | Lahde |
| 3,913,870 | A | 10/1975 | Bolick |
| 4,297,905 | A | 11/1981 | Hadekel |
| 4,307,653 | A | 12/1981 | Goes et al. |
| 4,476,969 | A | 10/1984 | Dykema |
| 4,621,266 | A | 11/1986 | Le Gall et al. |
| 4,974,493 | A | 12/1990 | Yeffman |
| 5,113,745 | A | 5/1992 | Allen |
| 5,339,789 | A | 8/1994 | Heitz |
| 6,227,098 | B1 | 5/2001 | Mason |
| 6,941,851 | B2 | 9/2005 | Urvoy |
| 7,870,814 | B2 | 1/2011 | Lounsbury |
| 8,028,611 | B2 | 10/2011 | Loundsbury |
| 8,220,448 | B1 | 7/2012 | Moggo |
| 9,146,068 | B2 * | 9/2015 | Hodgson ..... F41A 27/30 |
| 2011/0275435 | A1 | 11/2011 | Torre |
| 2012/0030984 | A1 | 2/2012 | Andersson |

* cited by examiner

MOTORIZED WEAPON GYROSCOPIC STABILIZER

RELATED APPLICATIONS

The present application is a continuation-in-part of currently pending U.S. patent application Ser. No. 13/738,186, filed on Jan. 10, 2013, which claims priority to U.S. Provisional Patent Application Ser. No. 61/585,267, filed on Jan. 11, 2012, the entire contents of both applications being incorporated herein by reference. The present application also claims priority to U.S. Provisional Patent Application Ser. No. 62/107,666, filed on Jan. 26, 2015, the entire contents of which being incorporated herein by reference.

BACKGROUND

The present application relates to weapon stabilizer systems. It finds particular application in utilizing a motorized weapon gyroscopic stabilizer to create a stabilizing effect for single shot, semi-automatic, and fully automatic weapons, and will be described with particular reference thereto. It is to be understood, however, that it also finds application in other devices, and is not necessarily limited to the aforementioned application.

Shooting a weapon depends on a high degree of precision. Slight movements made by the shooter significantly alter the accuracy of the shot. This variation in target alignment is made even more significant when compounded over long distances. Over time, shooters have been taught to minimize these movements by using a variety of methods to create stability and support of the weapon during target alignment and firing of the weapon. This desired stability of the target alignment is so critical that a shooter is taught to measure his breaths, and be aware of his heartbeats as he prepares for his shot. A small fraction of a degree in target misalignment when magnified over a long distance is enough to miss the target.

While there are a variety of sights, scopes, and aiming devices available for weapons, they only serve to make the shooter more aware of the existing deviations experienced during aiming and firing at his target. Typically, the shooter has the ability to support his weapon from the middle and/or rear with handgrips, and/or stock supports. When possible, a shooter enhances his stability by supporting the weapon with external stable surfaces available to him in his environment at the time. Unfortunately, due to the different conditions and environments in which a weapon is expected to function, the ideal support for the weapon is not always available. Without the aid of external stable surfaces for the weapon, the shooter is dependent on supporting the unsupported weapon with his skeletal structure incorporated into their position, and the steadiness of their muscles.

With a weapon, during the first shot, the shooter typically experiences recoil from the shot. During this recoil phase, the weapon typically moves as the projectile is fired and propelled and leaves the weapon. Typically, this recoil affects the least supported part of the weapon the most. This recoil causes alignment with the target to be altered, and requires subsequent shots to be made after adjusting target alignment, causing a delay in repeated firing and the ability to aim accurately. The less the natural recoil of the weapon affects the target alignment, the faster the target can be reacquired, and subsequent shots may be made. This recoil problem is present with single shot, semi-automatic, and fully automatic weapons.

Gyroscopes have been utilized in the past in a wide variety of stabilizing applications, but size, weight, and bulk have limited their application related to the handheld weapon field. Gyroscopes are heavy and cumbersome, and while used for applications such as on cameras, missiles, battleship guns, and tanks, they have never been practically used on handheld weapons.

The present application provides a weapon stabilizer system and apparatus which overcomes the above-referenced problems and others.

SUMMARY

In accordance with one aspect, a motorized weapon gyroscopic stabilizer system is provided. The system includes a housing including an open core rigidly (or semi-rigidly) mounted to a barrel of a weapon. A motor includes a rotor configured to provide gyroscopic stability, the rotor surrounding the open core and including an axis of rotation and a mass element configured to rotate around the axis of rotation.

The motorized weapon gyroscopic stabilizer improves the stability of a weapon during single shots, semi-automatic shots, and fully automatic shots through the use of a lightweight high speed motor driven gyroscopic stabilization device. The device relies on the three primary variables involved in creating gyroscopic stability; the mass of the spinning element, the speed of the spinning element, and the diameter of the spinning element. By altering any of these three variables, the gyroscopic stability is altered. However, emphasis may be placed on any of these three variables to overcome the limitations applied to any of the other variables.

To accomplish gyroscopic stability, the motorized weapon gyroscopic stabilizer utilizes a low mass, high speed motor driven gyroscope designed to spin on an axis parallel to the weapons direction of fire and/or target alignment method/device. The motorized weapon gyroscopic stabilizer also utilizes a method to increase the speed of the spinning mass to produce extremely high revolutions per minute allowing the device to lower the mass of the spinning mass element while achieving the same gyroscopic stability, thus making the device lighter.

In an embodiment, the device creates its gyroscopic stability through the spinning mass of its rotor, around its hollow core. The motor is designed to spin on an axis parallel to the weapons direction of fire and/or target alignment method/device.

The motorized weapon gyroscopic stabilizer is also designed to minimize bulk by integrating the gyroscope into the weapons natural structure emphasizing its attachment in line with the axis parallel to the weapons direction of fire and/or target alignment method/device. The device has a small rotational mass diameter and compensates for this through its high speed rotation. The diameter of the spinning mass element effects the function of a gyroscope. Increasing the diameter, increases the gyroscopic stability it generates. The motorized gyroscopic weapon stabilizer is designed with a hollow rotational axis which allows it to share space with other functional elements incorporated into weapons, such as, but not limited to; by way of example in a firearm type weapon; its barrel, its axis parallel to the weapons direction of fire, and/or with the target alignment—line of sight method/device natural to the firearm.

This sharing of space allows the motorized weapon gyroscopic stabilizer to incorporate with the natural form of the weapon, and prevent the bulk of adding a separate large cylindrical shape, which is essential to create a gyroscopic stabilizer, somewhere else on a weapon. Due to this form, it allows the device to be positioned as far away as practical from the already existing support surfaces on the weapon to maximize the gyroscopic stability it provides.

This motorized weapon gyroscopic stabilizer is designed to be either rigidly attached or be made removable from the weapon. The attachment method varies and is dependent on the design and the configuration of the specific weapon, and may be attached either permanently, or temporarily. This is fully capable of being added to, or removed from the weapon, or in being temporarily attached or permanently affixed into the weapons structure.

The motorized weapon gyroscopic stabilizer is designed to be either used independently, or incorporated into other devices including but not limited to; barrels, flash suppressors, silencers, noise suppressors, scopes, lasers, optics, holographic sights, target alignment devices, and other devices benefiting from its unique hollow core construction.

Still further advantages of the present disclosure will be appreciated by those of ordinary skill in the art upon reading and understanding the following detailed description.

Aspects of the present disclosure may take form in various components and arrangements of components, and in various steps and arrangements of steps. There are many forms of motors that can be used in connection with aspects of the present disclosure. For illustration purposes only, the following exemplary preferred embodiments show this a separate motor as well as an integral brushless motor. The drawings are only for purposes of illustrating the exemplary preferred embodiments and are not to be construed as limiting the present disclosure.

DETAILED DESCRIPTION

Figure 1:
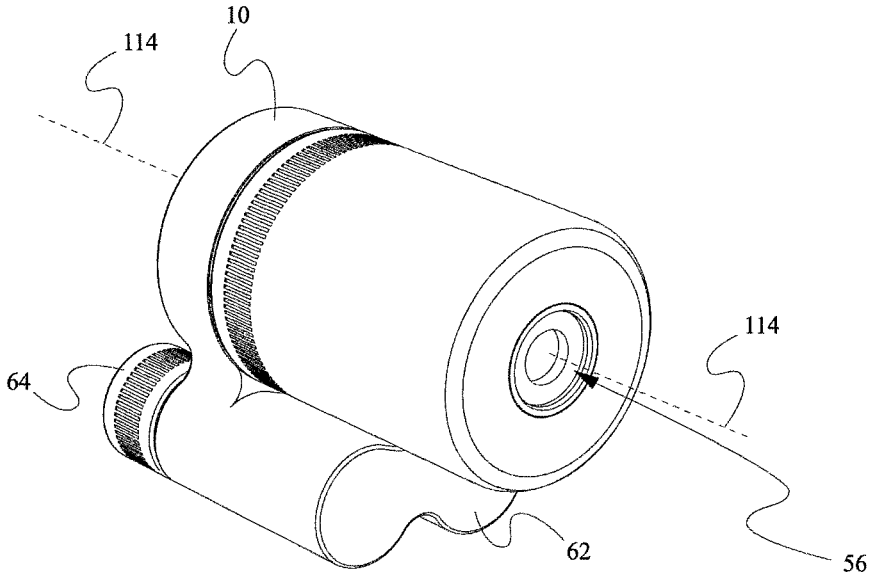
FIG. 1 is an illustration of the motorized weapon gyroscopic stabilizer as viewed from the front perspective view. In this view, the device is not mounted to a weapon.

FIG. 1 shows a front perspective view of an exemplary preferred embodiment of the motorized weapon gyroscopic stabilizer 10. This view of one embodiment shows the body of the stabilizer with an integrated battery or batteries holder 62 for powering the unit. The battery or batteries 82 are contained within the enclosure and secured in place with a battery cap or battery caps 64. This view shows the axis of rotation which is parallel to an axis of a trajectory 114 allowing a fired projectile to pass through the open core in the motorized gyroscopic weapon stabilizer 56.

Figure 2:
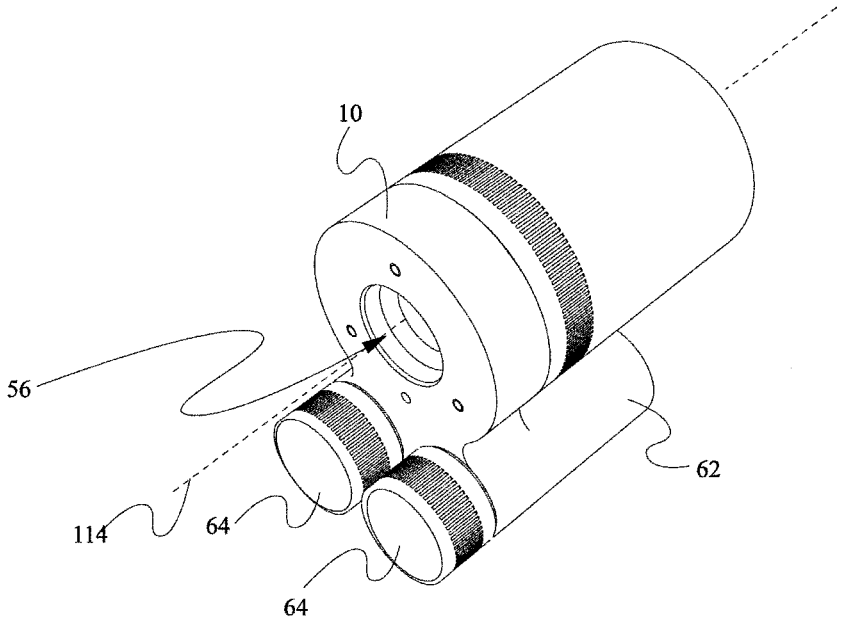
FIG. 2 is an illustration of the motorized weapon gyroscopic stabilizer as viewed from the rear perspective view. In this view, the device is not mounted to a weapon.

FIG. 2 shows a rear perspective view of the exemplary preferred embodiment of the motorized weapon gyroscopic stabilizer 10. This illustration of one embodiment shows the body of the device with an integrated battery or batteries holder 62 for powering the unit. The battery or batteries 82 are contained inside of the unit with temporarily secured battery cap or batteries caps 64. The battery cap or batteries caps 64 may be attached in a wide variety of ways; including but not limited to, by way of example; thread attached, independent hardware attached, snap fit, or friction fit. This view shows the axis of rotation which is parallel to an axis of a trajectory 114 allowing a fired projectile to pass through the open core in the motorized gyroscopic weapon stabilizer 56

Figure 3:
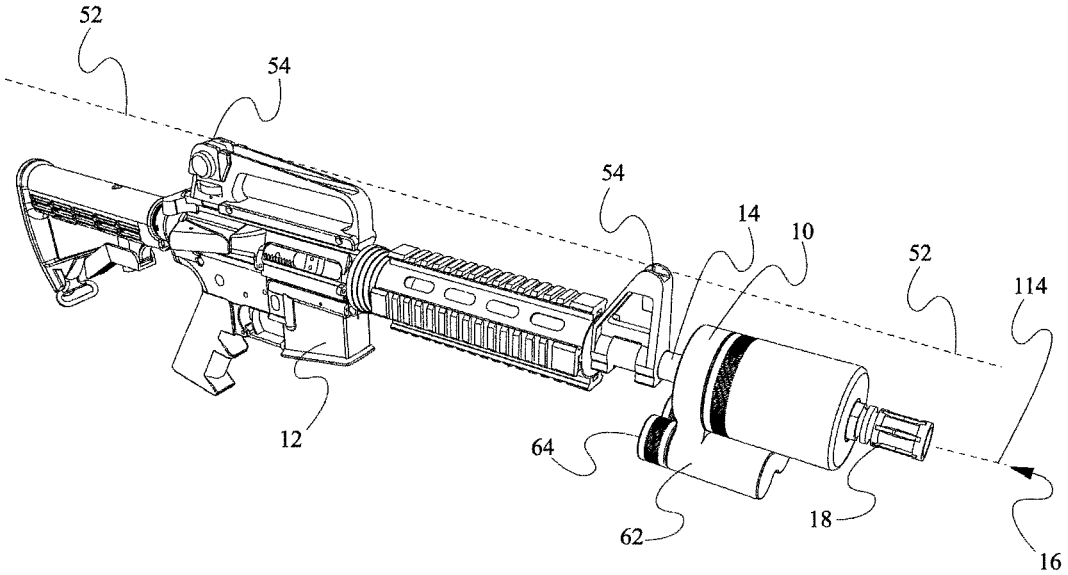
FIG. 3 is an illustration of the motorized weapon gyroscopic stabilizer mounted to a weapon, by way of example the barrel of a firearm.

With reference to FIG. 3, the motorized weapon gyroscopic stabilizer 10 is illustrated by way of example as being mounted onto the barrel 14 of a weapon 12. Such type of weapon 12 includes a single shot, semi-automatic, or fully automatic weapon 12 with either single or multiple barrels 14. By way of example, the motorized weapon gyroscopic stabilizer 10 is rigidly attached to the barrel 14 of a rifle type weapon 12. The barrel 14 passes through the motorized weapon gyroscopic stabilizer 10 and is secured by way of example by the attachment of a flash suppressor 18 or other retention method. This method of attachment is only one method of attaching the motorized weapon gyroscopic stabilizer 10 to a weapon 12. Since weapon 12 configurations vary significantly, the attachment method varies according to the weapon 12. The projectile exit 16 of the weapon 12 allows the projectile to pass through the motorized weapon gyroscopic stabilizer 10. The motorized weapon gyroscopic stabilizer 10 is intended to work with single and multiple barrel weapons 12. The motorized weapon gyroscopic stabilizer 10 provides stability to the weapon 12 by the extremely fast rotation of the cylinder of mass around the hollow core of the device. The center of rotation as shown by way of example is aligned with the barrel 14 of the weapon 12 so that the projectile passes through the motorized gyroscopic weapon stabilizer 10 along an axis of rotation which is parallel to an axis of a trajectory 114. In other configurations, the motorized weapon gyroscopic stabilizer 10 allows the target alignment—line of sight 52 to pass through the device, or function having both the target alignment—line of sight 52 and the axis of the projectile exit 16 aligned through the motorized gyroscopic weapon stabilizer 10 allowing the projectile to pass through the device as well. The sighting mechanism 54 used on the weapon may vary considerably, which include visual, non-magnified, magnified, optical or other types of sighting mechanisms 54 designed to create target alignment—line of sight 52 function through the open core of this device.

Figure 4:
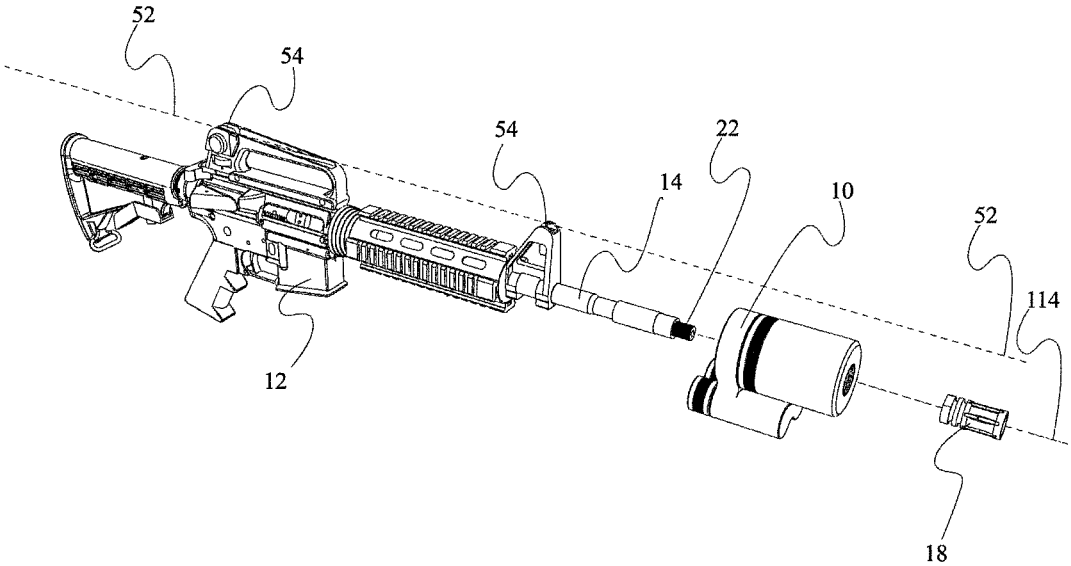
FIG. 4 is an illustration of the motorized weapon gyroscopic stabilizer mounted to a weapon through one of the many ways of attachment by way of example the barrel of a firearm.

In FIG. 4, the motorized weapon gyroscopic stabilizer 10 is shown being mounted onto a weapon 12 in another example. As illustrated, the motorized weapon gyroscopic stabilizer 10 is shown by way of example on a rifle type weapon 12 being rigidly attached by using the threaded portion of the barrel 22 of the weapon 12 along with the threaded flash suppressor 18 normal to this type of weapon 12. In other rifle or pistol type weapons 12, the motorized weapon gyroscopic stabilizer 10 is attached onto the barrel 14, or in front of the barrel 14 with different brackets or attachment modifications making it; permanently incorporated into the barrel 14, rigidly fixed to the barrel 14, or temporarily fixed to the barrel 14 depending on the application. The motorized weapon gyroscopic stabilizer 10 is able to be mounted in similar ways to the weapon 12 with the target alignment—line of sight 52 passing through it. The mass of rotation has an axis of rotation which is parallel to an axis of a trajectory 114 of a fired projectile and/or target alignment—line of sight 52.

Figure 5:
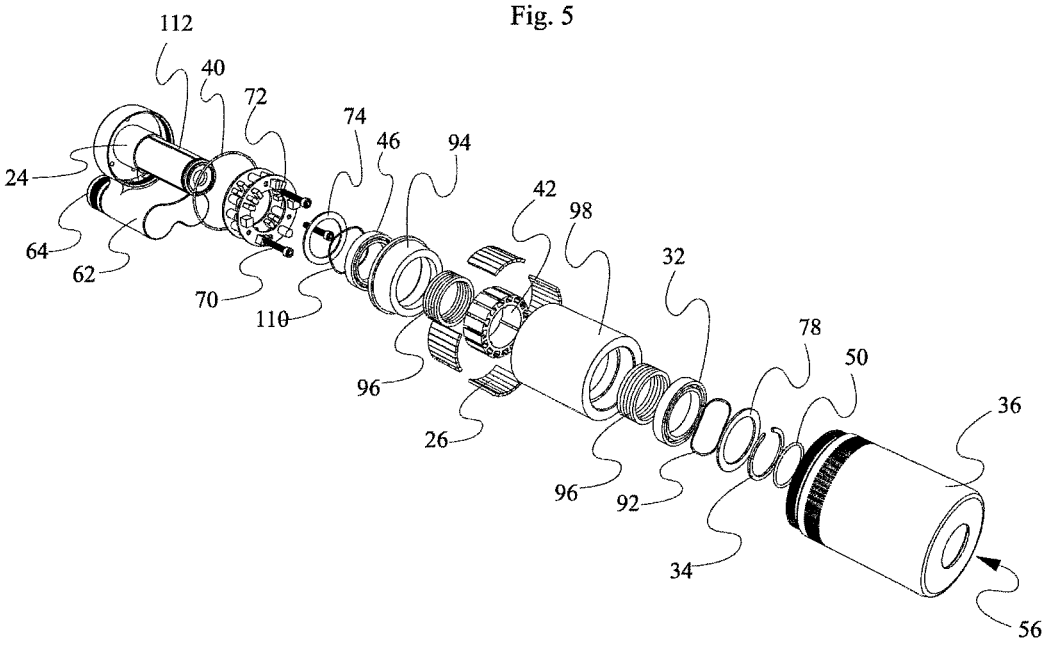
FIG. 5 is an illustration of an exploded view of the motorized weapon gyroscopic stabilizer as constructed by way of example as an integral motor version.

FIG. 5 illustrates an exploded view of the motorized weapon gyroscopic stabilizer 10 as constructed by way of example as an integral motor version of the motorized weapon gyroscopic stabilizer 10. The spinning mass can be made as a one piece or as a multiple piece assembly. By way of example, in this exemplary preferred embodiment of the device, the spinning mass is made of two halves joined together; the front rotor half 98 and the rear rotor half 94. When assembled together, the two comprise a complete spinning mass. In this embodiment of the device, the inner housing 24 is created with an integrated battery or batteries holder 62 to allow the placement of a battery or batteries 82 inside the main inner housing 24. The battery or batteries 82 are sealed by using a battery cap or battery caps 64. The battery cap or battery caps 64 can be threaded, snapped, friction fit, mechanically attached, clipped or any other attachment method, in place, but are shown in this exemplary preferred embodiment as thread attached to the battery or batteries holder 62 portions of the inner housing 24. The inner housing 24 is designed to create the open core shaft of the motorized weapon gyroscopic stabilizer 10, allowing it to be mounted to a weapon 12 in a variety of ways. The inner housing 24 is rigidly attached to the outer housing 36, making water resistant assembly possible. By way of example, the inner housing 24 is shown as threaded, although there are many different methods to rigidly attach the inner housing 24 to the outer housing 36. The inner housing 24 may be constructed of a wide variety of different materials. The rear ring seal 40 attaches to the inner housing 24 to create the rear portion of the water resistant seal to the elements. An electronic power board 72 houses electronics which powers and controls the motorized gyroscopic weapon stabilizer 10. The electronic power board 72 controls the operation of the motor, and is programmed to provide speeds and start-stop settings for the motor function. The electronic power board 72 can be rigidly attached to the inside of the inner housing 24 or may be located on different locations on the weapon 12 depending on the configuration of the weapon 12. The retaining screws 70 secure the electronic power board 72 to the inner housing 24 and hold the elements in position inside the motorized gyroscopic weapon stabilizer 10. The rear ring 74 is positioned around the shaft portion of the inner housing 112 and the rear side of the rear wavy spring 110. The rear wavy spring 110 provides constant pressure against the rear bearing 46. The rear bearing 46 is pressed into the rear rotor half 94. The rear bearing 46 may be several types of construction, including but not limited to a ball, wheel, roller, radial ball, angular contact, tapered roller, spherical roller, cylindrical roller, pillow block, thrust roller, needle roller, magnetic, or non-contact bearing. The rear bearing 46 materials may be varied and include, but not limited to; metal, plastic, non-ferrous or ceramic construction. The rear bearing 46 is positioned around the shaft portion of the inner housing 112. The spacer rings 96 are positioned around the shaft portion of the inner housing 112 and are located between the rear bearing 46 and the stator and windings 42. The wire windings of the stator and windings 42 are not shown in the illustration for clarity. The stator and windings 42 are engaged into channels around the shaft portion of the inner housing 112 to prevent rotation of the stator and windings 42. The stator and windings 42 are formed from stacks of electric steel with wire windings wound around their poles. The pattern of the stator and windings 42 are varied according to the desired speed and torque of the motor. The magnets 26 are bonded on the inside of the front rotor half 98 to create the magnetic portion of the motor. The magnets 26 count and spacing may be varied according to the desired speed and torque of the motor, and to adjust the magnetic poles of the motor. The magnets 26 are shown as independent elements but may be constructed as an integrated formed magnetic pole section in many different configurations. Another set of spacer rings 96 are positioned around the shaft portion of the inner housing 112 and is located between the front of the stator and windings 42 and the front bearing 32. The front bearing 32 is pressed inside of the front rotor half 98. The front bearing 32 may be several types of construction, including but not limited to a ball, wheel, roller, radial ball, angular contact, tapered roller, spherical roller, cylindrical roller, pillow block, thrust roller, needle roller, magnetic, or non-contact bearing. The front bearing 32 materials may be varied and include, but not limited to; metal, plastic, non-ferrous or ceramic construction. The front wavy washer 92 provides constant pressure against the front bearing 32. The front wavy washer 92 is positioned around the shaft portion of the inner housing 112 and is located between the front bearing 32 and the front ring 78. The front retainer 34 is positioned around the shaft portion of the inner housing 112 and is located in front of the front ring 78. The front retainer 34 positively engages into a groove in the inner housing 24 for fixed positioning. The rear ring seal 40 and the front ring seal 50 are designed to compress between the shaft portion of the inner housing 112 and the outer housing 36 to form a water resistant seal, protecting the inner workings of the motorized gyroscopic weapon stabilizer 10 from the elements. The outer housing 36 is rigidly attached to the inner housing 24. The attachment of the inner housing 24 to the outer housing 36 may be made in many different ways, but is illustrated by way of example as a threaded attachment. The outer housing 36 provides protection to the internal elements of the motorized gyroscopic weapon stabilizer 10. The outer housing 36 may be constructed of a wide variety of different materials. Traditional motors are designed to make the motor shaft rotate. Unlike traditional motors, this integrated motor is designed to having the inner stator and windings 42 fixed in place. The main spinning mass is comprised of the rear rotor half 94 and the front rotor half 98 with its attached magnets 24. This formed spinning mass is designed to spin around the fixed shaft portion of the inner housing 112 which functions as a non-rotating shaft. In this motorized gyroscopic weapon stabilizer 10, the shaft portion of the inner housing 112 functions as the motor shaft, and the rotor is made to rotate, creating the gyroscopic force. The rotor comprised of the rear rotor half 94 and the front rotor half 98 has both front bearing 32 and rear bearing 46 pressed inside of it, and magnets 26 are internally bonded to the inner surface of the front rotor half 98. The resulting spinning mass is designed to spin at a significant speed. This view also shows the open core in the motorized gyroscopic weapon stabilizer 56.

Figure 6:
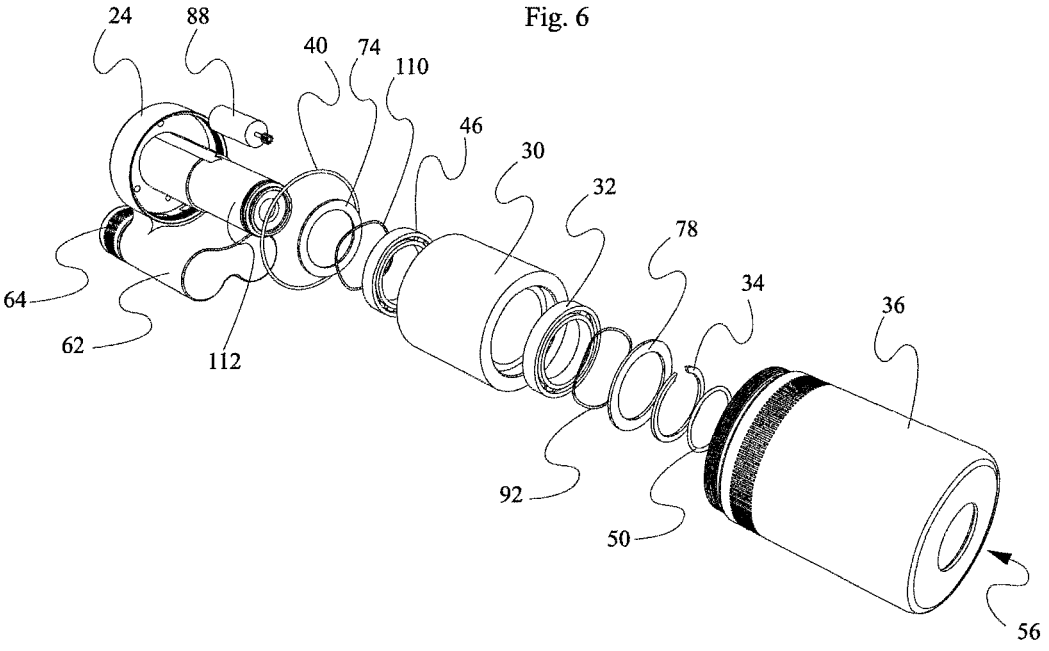
FIG. 6 is an illustration of an exploded view of the motorized weapon gyroscopic stabilizer as constructed by way of example as a separate motor driven version.

FIG. 6 illustrates an exploded view of the motorized weapon gyroscopic stabilizer 10 as constructed by way of example as a separate motor 88 driven version of the motorized weapon gyroscopic stabilizer 10. In this embodiment of the device, the inner housing 24 is created with an integrated battery or batteries holder 62 to allow the placement of a battery or batteries 82 inside the main inner housing 24. The battery or batteries 82 are sealed by using a battery cap or battery caps 64. The battery cap or battery caps 64 can be threaded, snapped, friction fit, mechanically attached, clipped or any other attachment method, in place, but are shown in this exemplary preferred embodiment as thread attached to the battery or batteries holder 62 portions of the inner housing 24. The inner housing 24 has an integrated front portion designed to create the shaft portion of the inner housing 112 of the motorized weapon gyroscopic stabilizer 10, allowing it to be mounted to a weapon 12 in a variety of ways. The inner housing 24 is rigidly attached to the outer housing 36, making water resistant assembly possible. By way of example, the inner housing 24 is shown as threaded, although there are many different methods to rigidly attach the inner housing 24 to the outer housing 36. The inner housing 24 may be constructed of a wide variety of different materials. The rear ring seal 40 attaches to the inner housing 24 to create the rear portion of the water resistant seal to the elements. A separate motor 88 mounts to the inner housing 24. The separate motor 88 is designed to drive the rotor 30 and generate gyroscopic stabilization. By way of example the separate motor 88 is mounted to the inner housing 24 using, by way of example, but not limited to; screws, hardware, clips, friction fits, press fits, snaps, adhesives, or other attachment methods. The separate motor 88 may be constructed in a wide variety of ways and may have internal regulating or external regulating circuitry that provides the necessary motor control desired. The regulating circuitry can be rigidly attached to the inside of the inner housing 24 or may be located on different locations on the weapon 12 depending on the configuration of the weapon 12. The rear ring 74 is positioned around the shaft portion of the inner housing 112 and the rear side of the rear wavy spring 110. The rear wavy spring 110 provides constant pressure against the rear bearing 46. The rear bearing 46 is pressed into the rear of the rotor 30. The rear bearing 46 may be several types of construction, including but not limited to a ball, wheel, roller, radial ball, angular contact, tapered roller, spherical roller, cylindrical roller, pillow block, thrust roller, needle roller, magnetic, or non-contact bearing. The rear bearing 46 materials may be varied and include, but not limited to; metal, plastic, non-ferrous or ceramic construction. The rear bearing 46 is positioned around the shaft portion of the inner housing 112. The front bearing 32 is pressed into the front of the rotor 30. The front bearing 32 may be several types of construction, including but not limited to a ball, wheel, roller, radial ball, angular contact, tapered roller, spherical roller, cylindrical roller, pillow block, thrust roller, needle roller, magnetic, or non-contact bearing. The front bearing 32 materials may be varied and include, but not limited to; metal, plastic, non-ferrous or ceramic construction. The front bearing 32 is positioned around the shaft portion of the inner housing 112. The front wavy spring 92 is positioned around the shaft portion of the inner housing 112 and located between the front bearing 32 and the front ring 78. The front wavy spring 92 provides constant pressure against the front bearing 32. The front ring 78 is positioned around the shaft portion of the inner housing 112 and located between the front wavy spring 92 and the front retainer 34. The front retainer 34 is positioned around the shaft portion of the inner housing 112 and located in front of the front ring 78. The front retainer 34 positively engages into a groove in the inner housing 24 for fixed positioning. The rear ring seal 40 and the front ring seal 50 are designed to compress between the shaft portion of the inner housing 112 and the outer housing 36 to form a water resistant seal, protecting the inner workings of the motorized gyroscopic weapon stabilizer 10 from the elements. The outer housing 36 is rigidly attached to the inner housing 24. The attachment of the inner housing 24 to the outer housing 36 may be made in many different ways, but is illustrated by way of example as a threaded attachment. The outer housing 36 provides protection to the internal elements of the motorized gyroscopic weapon stabilizer 10. The outer housing 36 may be constructed of a wide variety of different materials. The separate motor 88 is designed to make the rotor 30 rotate. This rotor 30 is designed to spin around the fixed shaft portion of the inner housing 112 which functions as a non-rotating shaft. In this motorized gyroscopic weapon stabilizer 10, the shaft portion of the inner housing 112 functions as the central shaft of the rotor 30. The rotor 30 is designed to rotate at a high speed, creating gyroscopic force. In one preferred embodiment, the connection between the separate motor 88 and the rotor 30 is shown by way of example, but not limited to; as a gear driven connection, although the connection could also be made through friction, belts, gears, or magnetically linked separate motor 88 and rotor 30. By way of example, the location of the separate motor 88 is shown to contact the rotor 30 from within, although the separate motor 88 alignment to the rotor could be made from the inside, the outside, on the edge, or in parallel, or in any orientation to the rotor 30 which has an axis of rotation which is parallel to an axis of a trajectory 114 of a fired projectile and/or target alignment line of sight 52. This view also shows the open core in the motorized gyroscopic weapon stabilizer 56.

Figure 7:
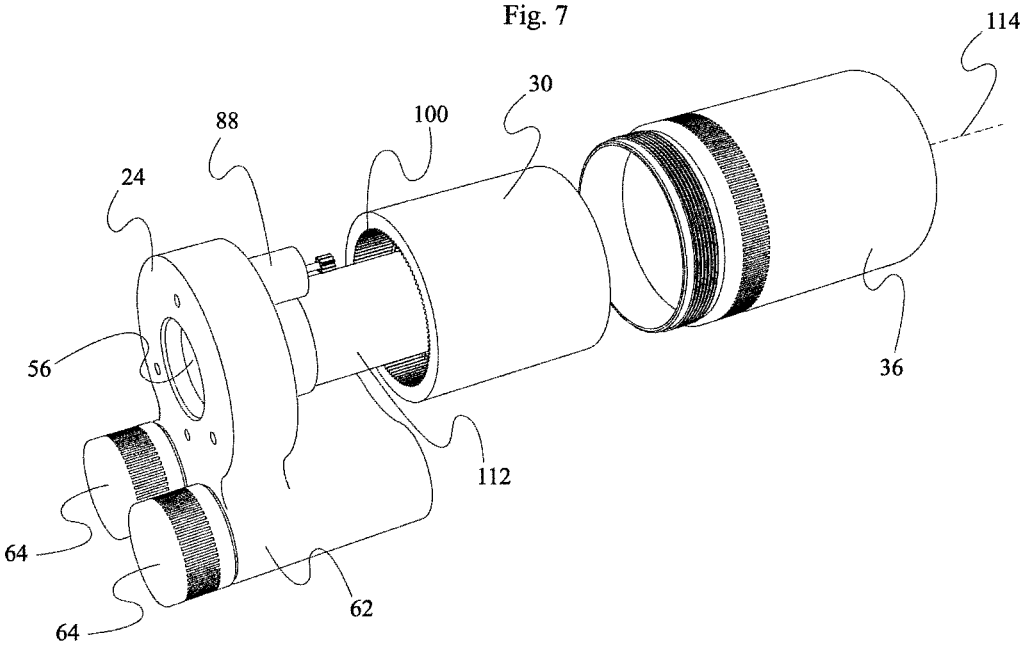
FIG. 7 is an illustration of a rear perspective exploded view of the motorized weapon gyroscopic stabilizer as constructed by way of example as a separate motor driven version.

FIG. 7 illustrates a rear perspective exploded view of the motorized weapon gyroscopic stabilizer 10 as constructed by way of example as a separate motor 88 driven version of the motorized weapon gyroscopic stabilizer 10. In this view, the separate motor 88 embodiment is shown in a clearer view showing the gears cut in the inside of the rotor 100 inside the rotor 30. In this view, the rear ring seal 40, rear ring 74, rear wavy washer 110, rear bearing 46, front bearing 32, front wavy washer 92, front ring 78, front retainer 34, and front ring seal 50, are obscured from view. The shaft portion of the inner housing 112 functions as the central shaft of the rotor 30. The rotor 30 is designed to rotate at a high speed, creating gyroscopic force. In its preferred embodiment, the connection between the separate motor 88 and the rotor 30 is shown by way of example, but not limited to; as a gear driven connection, although the drive connection could also be made as, but not limited to; friction, belts, gears, or magnetically linked drives. By way of example, the location of the separate motor 88 is shown to contact the rotor 30 from within, although the separate motor 88 alignment to the rotor could be made from the inside, the outside, on the edge, or in parallel, or in any orientation to the rotor 30 which has an axis of rotation which is parallel to an axis of a trajectory 114 of a fired projectile and/or target alignment line of sight 52 through the open core in the motorized gyroscopic weapon stabilizer 56. The inner mechanisms of the motorized gyroscopic weapon stabilizer 10 is protected by the outer housing 36.

Figure 8:
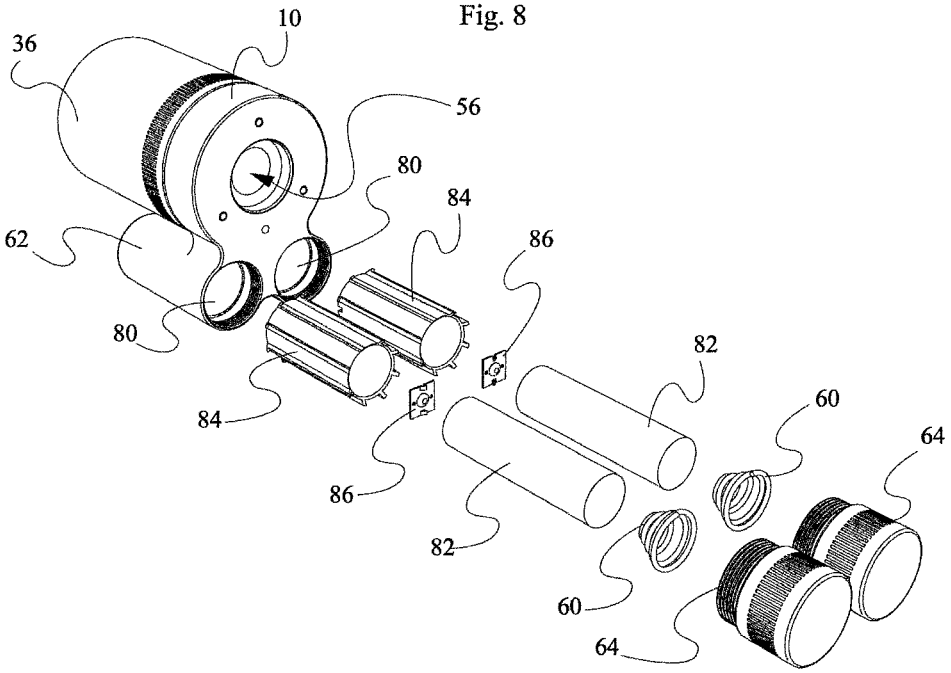
FIG. 8 is a view of the motorized weapon gyroscopic stabilizer in a rear exploded view showing by way of example an integral battery containment system.

FIG. 8 illustrates the motorized gyroscopic weapon stabilizer 10 with its integrated battery or batteries holder 62. There are many ways of incorporating a battery or batteries 82 into the device, including but not limited to this embodiment. In one preferred embodiment, by way of example, the device is shown with multiple insulated battery holder inserts 84 which hold the electrical terminals 86. The insulated battery holder inserts 84 are inserted into the opening for battery or batteries 80. The battery or batteries 82 are inserted into the insulated battery holder inserts 84 and make connection with the electrical terminals 86 and the battery holder springs 60. The battery or batteries 82 are sealed by using a battery cap or battery caps 64. The battery cap or battery caps 64 can be threaded, snapped, friction fit, mechanically attached, clipped or any other attachment method, in place, but are shown in one preferred embodiment as thread attached to the battery or batteries holder 62 portions of the motorized gyroscopic weapon stabilizer 10. This view also shows the open core in the motorized gyroscopic weapon stabilizer 56.

Figure 9:
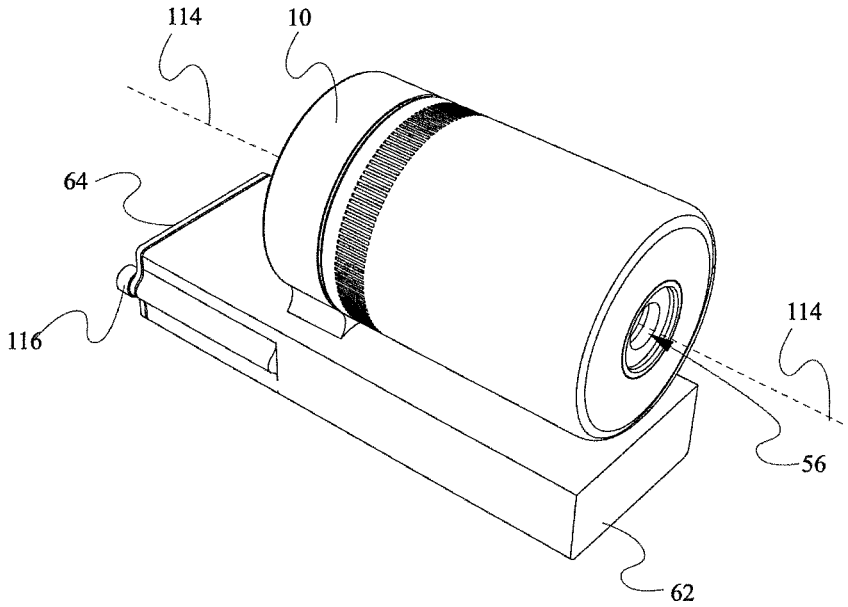
FIG. 9 is an illustration of the motorized weapon gyroscopic stabilizer attached in an alternate by way of example as an extension of the barrel of a firearm.

FIG. 9 illustrates the front perspective view of an alternative battery or batteries holder 62 of the motorized gyroscopic weapon stabilizer 10 by way of example through using a different shaped battery or batteries 82. This battery or batteries 82 may be constructed of a wide variety of chemical formulations such as by way of example but not limited to; lithium polymer, lithium Ion, nickel-metal hydride, lead-acid, nickel-zinc, nickel-cadmium, alkaline and shapes and sizes. The battery or batteries 82 may also be constructed in a wide variety of shapes and sizes by way of example as a; cylinder, rectangle, square, or custom shaped battery. The battery or batteries 82 may be made to be rechargeable or replaceable, and may be made securely fixed in position, or may be made removable by using a type of battery cap or battery caps 64. There are many methods of securing the battery or batteries 82 and or the battery or battery caps 64 onto the motorized gyroscopic weapon stabilizer 10 shown by way of example by using screw type fasteners. These many methods of attachment include but are not limited to using; clips, screws, straps, snaps, friction fits bails, rigid hinged or flexible hinged doors, slides, or special types of fasteners. This view also shows the open core in the motorized gyroscopic weapon stabilizer 56 and the motorized gyroscopic weapon stabilizer 10 axis of rotation which is parallel to an axis of trajectory 114.

Figure 10:
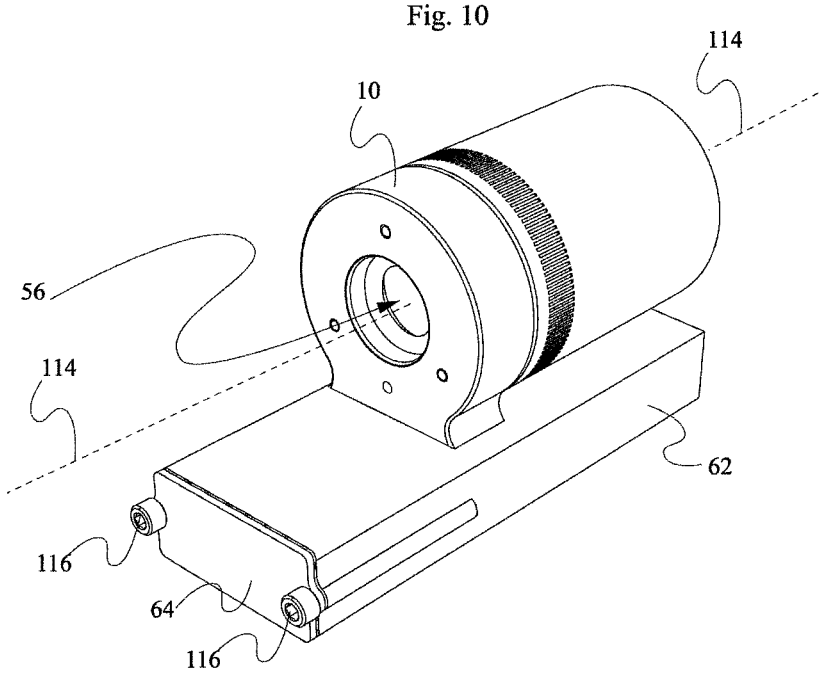
FIG. 10 is an illustration of the motorized weapon gyroscopic stabilizer attached to the barrel of a pistol type firearm.

FIG. 10 illustrates the rear perspective view of the alternative battery or batteries holder 62 of the motorized gyroscopic weapon stabilizer 10. In this view, the rear of the motorized gyroscopic weapon stabilizer 10 is clearly shown with its battery cap or battery caps 64 secured with its cover screws 116. This view also shows the open core in the motorized gyroscopic weapon stabilizer 56 and the motorized gyroscopic weapon stabilizer 10 axis of rotation which is parallel to an axis of trajectory 114.

Figure 11:
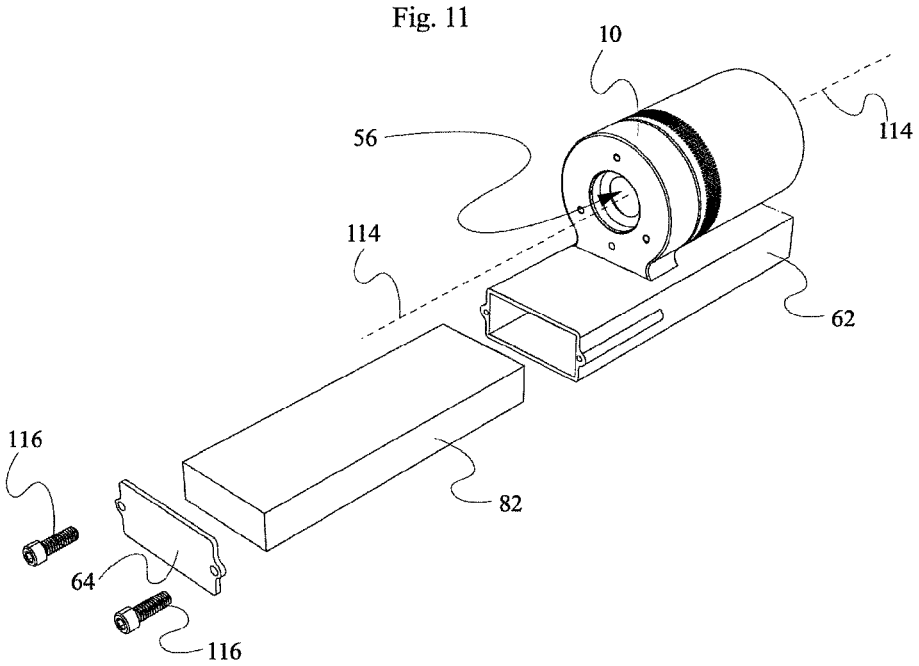
FIG. 11 is an illustration of the motorized weapon gyroscopic stabilizer attached by way of example to the barrel of a rifle type weapon with the projectile passing though the motorized gyroscopic weapon stabilizer, and the target alignment—line of sight not passing through the motorized gyroscopic weapon stabilizer.

FIG. 11 illustrates the rear perspective exploded view of the alternative battery or batteries holder 62 of the motorized gyroscopic weapon stabilizer 10 showing its battery or batteries 82 exposed, and the battery cap or battery caps 64 along with one of many securement methods as by way of example cover screws 116. This view shows the open core in the motorized gyroscopic weapon stabilizer 56 and the motorized gyroscopic weapon stabilizer 10 axis of rotation which is parallel to an axis of trajectory 114.

Figure 12:
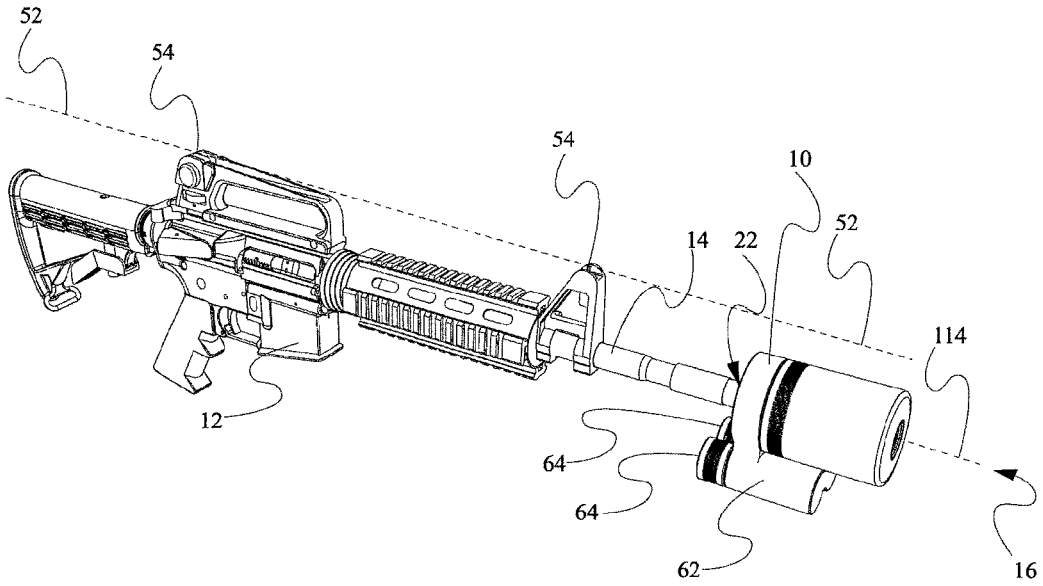
FIG. 12 is an illustration of the motorized weapon gyroscopic stabilizer attached by way of example to a rifle type firearm allowing the target alignment—line of sight to pass through the open core of the motorized gyroscopic weapon stabilizer.

FIG. 12 illustrates an alternative mounting position of the motorized gyroscopic weapon stabilizer 10 by way of example in front of the barrel 14 of a rifle type weapon 12. In this illustration, the motorized gyroscopic weapon stabilizer 10 is shown mounted in front of the barrel 14, extending the overall length of the weapon 12. Due to the open core design of this device, the motorized gyroscopic weapon stabilizer 10 is configured to perform additional functions by incorporating other barrel 14 related accessories into the design of the device, such as, but not limited to; flash suppressors, muzzle breaks, and or sound suppressors, gas tubes, or anything used in conjunction with the barrel 14 or target alignment—line of sight 52 or axis of rotation which is parallel to an axis of a trajectory 114 of a fired projectile function of the weapon 12 which would benefit by the open core construction of this device. This view also shows the projectile exit 16 in this embodiment of the device.

Figure 13:
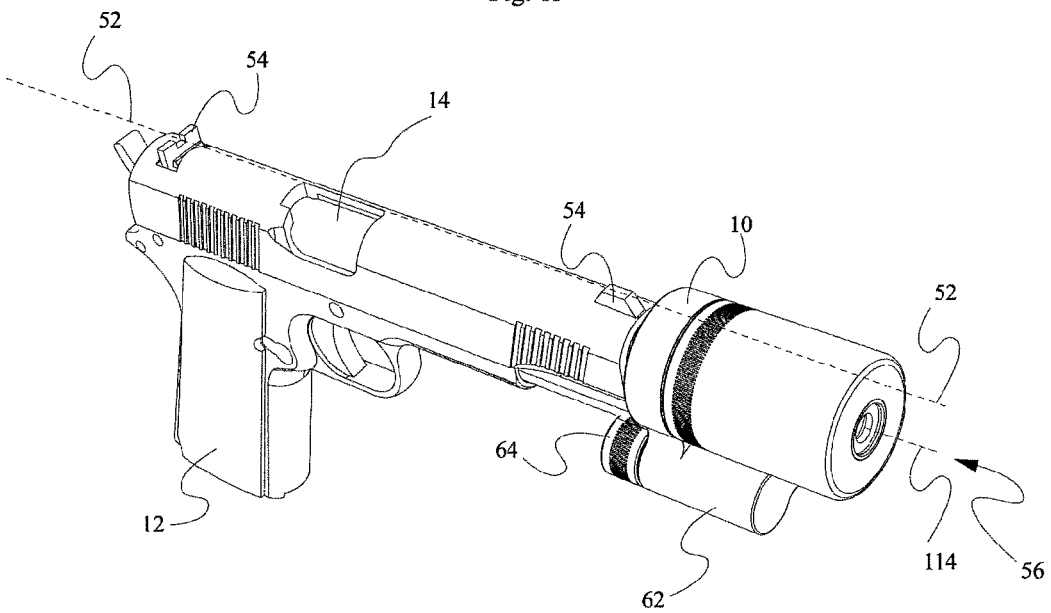
FIG. 13 illustrates the motorized gyroscopic weapon stabilizer by way of example rigidly attached to a pistol type weapon, showing the flexibility of the devices design.

FIG. 13 illustrates the motorized gyroscopic weapon stabilizer 10 by way of example rigidly attached to a pistol type weapon 12, showing the flexibility of the devices design. Because pistol type weapons 12 vary in configuration significantly, the method of attachment to the pistol type weapon 12 will vary as well. This illustration also shows how the target alignment—line of sight 52 is above the motorized gyroscopic weapon stabilizer 10, while the open core in the motorized gyroscopic weapon stabilizer 56 is aligned through the motorized gyroscopic weapon stabilizer 10 allowing the projectile to pass through it. It is also contemplated that the motorized gyroscopic weapon stabilizer 10 can be mounted to a wide variety of weapons and configured to allow either the target alignment—line of sight 52, or the axis of rotation which is parallel to an axis of a trajectory 114 of a fired projectile to pass through the open core in the motorized gyroscopic weapon stabilizer 56, or both simultaneously.

Figure 14:
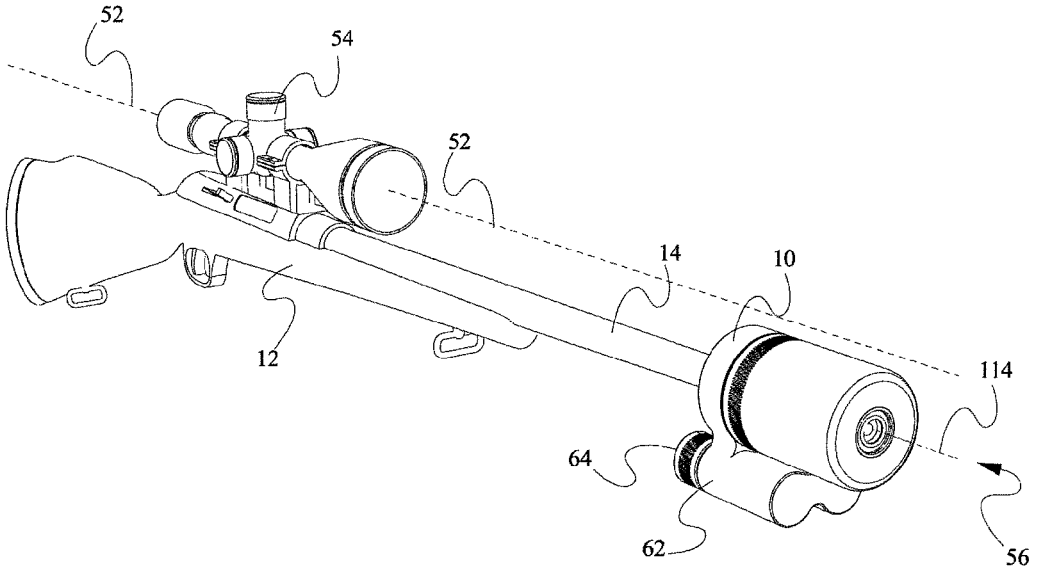
FIG. 14 illustrates the motorized gyroscopic weapon stabilizer by way of example rigidly attached to the barrel of a rifle type weapon with the target alignment—line of sight passing through the sighting mechanism.

FIG. 14 illustrates the motorized gyroscopic weapon stabilizer 10 by way of example rigidly attached to the barrel 14 of a rifle type weapon 12. Because rifle type weapons 12 vary in configuration significantly, the method of attachment to the rifle type weapon 12 will vary as well. In this example, the target alignment—line of sight 52 passes through the sighting mechanism 54 which by way of example and includes, but is not limited to a telescopic type alignment device. By way of example, the target alignment—line of sight 52 in this drawing does not pass through the motorized gyroscopic weapon stabilizer 10, although the motorized gyroscopic weapon stabilizer 10 is attached by way of example to the rifle type weapon 12 barrel 14, allowing the projectile to pass through the open core in the motorized gyroscopic weapon stabilizer 56 which has an axis of rotation which is parallel to an axis of a trajectory 114 of a fired projectile.

Figure 15:
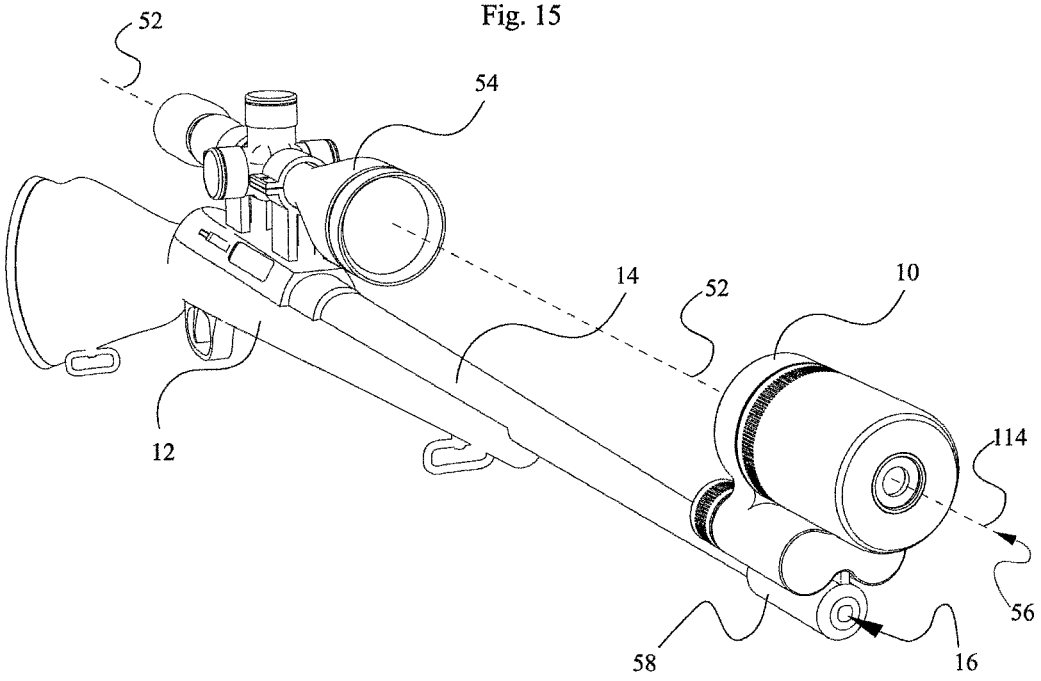
FIG. 15 illustrates the motorized gyroscopic weapon stabilizer as mounted by way of example to a rifle type weapon with the target alignment—line of sight of the sighting mechanism passing through the open core in the motorized gyroscopic weapon stabilizer.

FIG. 15 illustrates the motorized gyroscopic weapon stabilizer 10 as mounted by way of example to a rifle type weapon 12. It is mounted to the barrel 14 of the weapon 12 by a support for the motorized gyroscopic weapon stabilizer 58, allowing the target alignment—line of sight 52 of the sighting mechanism 54 to pass through the open core in the motorized gyroscopic weapon stabilizer 56. In this configuration, the projectile does not pass through the open core of the motorized gyroscopic weapon stabilizer 10, but the target alignment—line of sight 52 passes through the axis of rotation which is parallel to an axis of trajectory and the open core in the motorized gyroscopic weapon stabilizer 114.

Figure 16:
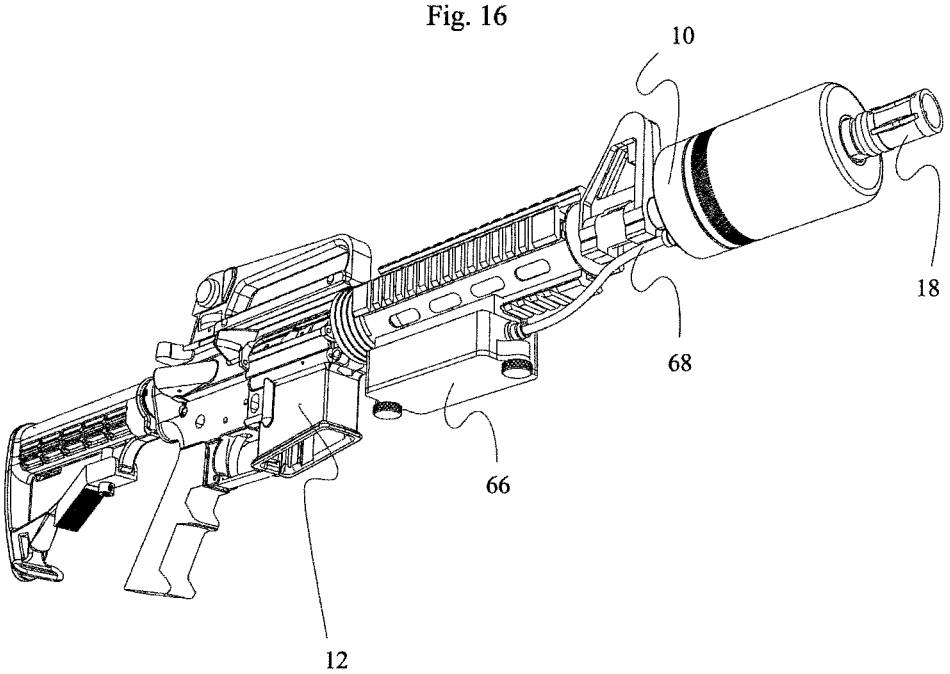
FIG. 16 illustrates a different embodiment of the motorized gyroscopic weapon stabilizer as mounted by way of example to a rifle type weapon with the battery case mounted to the gun rail and connected by a power cable.

FIG. 16 illustrates a different embodiment of the motorized gyroscopic weapon stabilizer 10 as mounted by way of example to a rifle type weapon 12. In this illustration, the motorized gyroscopic weapon stabilizer 10 is positioned on the barrel with the flash suppressor 18 located in front of it. The gyroscopic weapon stabilizer 10 is connected by way of example to the battery case 66 mounted to the weapon 12 by a power cable 68. This battery case 66 mounted to weapon 12 connected to the power cable 68 provides the energy needed to power the motorized gyroscopic weapon stabilizer 10. The battery case 66 may take many forms by way of example but not limited to; as a rectangle, cylinder, square, freeform or other entity such as a handgrip or stock.

Figure 17:
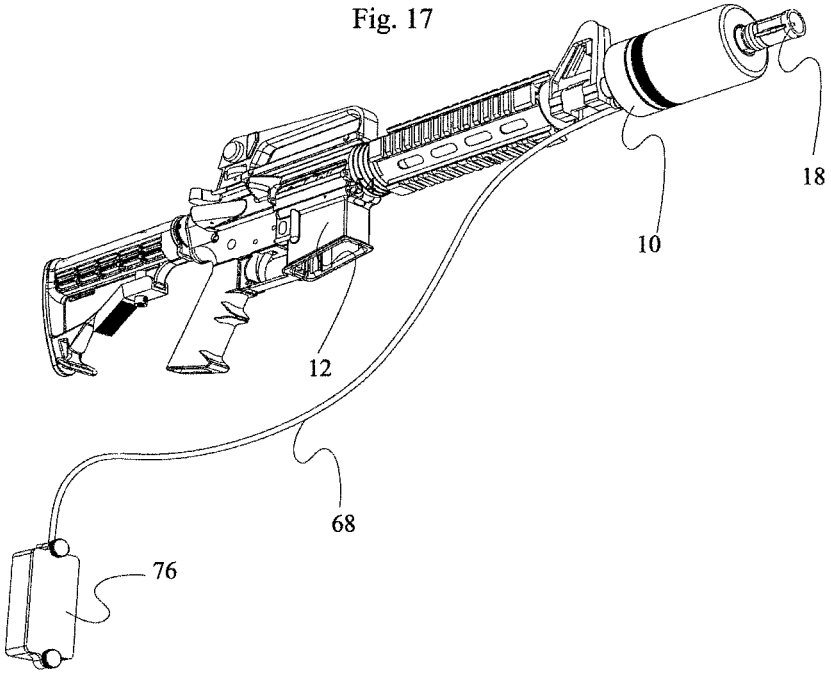
FIG. 17 illustrates an embodiment of the motorized gyroscopic weapon stabilizer as mounted by way of example to a rifle type weapon with the gyroscopic weapon stabilizer is connected by way of example to the remote battery case by a power cable.

FIG. 17 illustrates another embodiment of the motorized gyroscopic weapon stabilizer 10 as mounted by way of example to a rifle type weapon 12. In this illustration, the motorized gyroscopic weapon stabilizer 10 is positioned on the barrel 14 with the flash suppressor 18 located in front of it. The gyroscopic weapon stabilizer 10 is connected by way of example to the remote battery case 76 by a power cable 68. This remote battery case 76 may be attached to the user in a wide variety of ways such as by way of example through the use of a; belt attachment, pockets, harness, direct attachment to clothing, backpack, etc. and then connected to the power cable 68 providing the energy needed to power the motorized gyroscopic weapon stabilizer 10. The remote battery case 67 may take many forms by way of example but not limited to; as a rectangle, cylinder, square, freeform or other entity such as a handgrip or stock.

Figure 18:
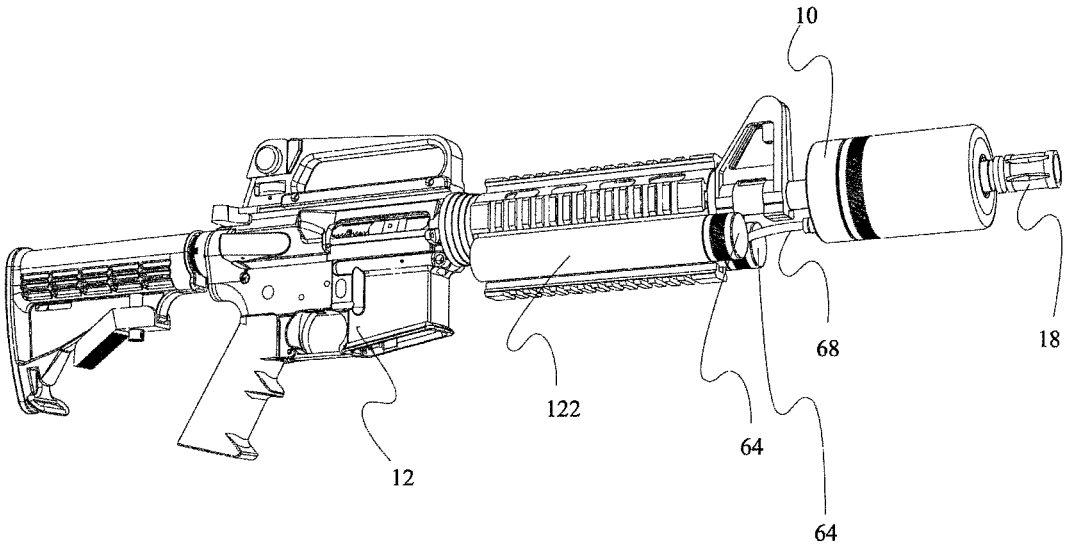
FIG. 18 illustrates another embodiment of the motorized gyroscopic weapon stabilizer as mounted by way of example to a rifle type weapon, attached to a power cable attached to a battery case incorporated into the weapon housing—stock—hand grip.

FIG. 18 illustrates another embodiment of the motorized gyroscopic weapon stabilizer 10 as mounted by way of example to a rifle type weapon 12. In this illustration, the motorized gyroscopic weapon stabilizer 10 is positioned on the barrel 14 with the flash suppressor 18 located in front of it. There are many areas within the structure of the weapon that have adequate space to house the battery or batteries 82. In this illustration, the gyroscopic weapon stabilizer 10 is connected by way of example to the battery case 66 incorporated into the weapon housing—stock—hand grip 122 by a power cable 68. The battery case 66 incorporated into the weapon housing—stock—hand grip 122 can be made in several different ways and with different materials, and designed to hold the battery or batteries 82 in many different ways with different closure methods depending on the construction of the weapon 12. In a preferred embodiment, the weapon housing—stock—handgrip 122 holds the battery or batteries 82 secured by the battery cap or battery caps 64. The weapon housing—stock—hand grip 122 may be connected directly to the motorized gyroscopic weapon stabilizer 10, or as shown in the illustrated embodiment, may be connected to it by the use of a power cable 68 providing the energy needed to power the motorized gyroscopic weapon stabilizer 10. The battery case 66 may take many forms by way of example but not limited to; as a rectangle, cylinder, square, freeform or other entity such as a handgrip or stock.

Figure 19:
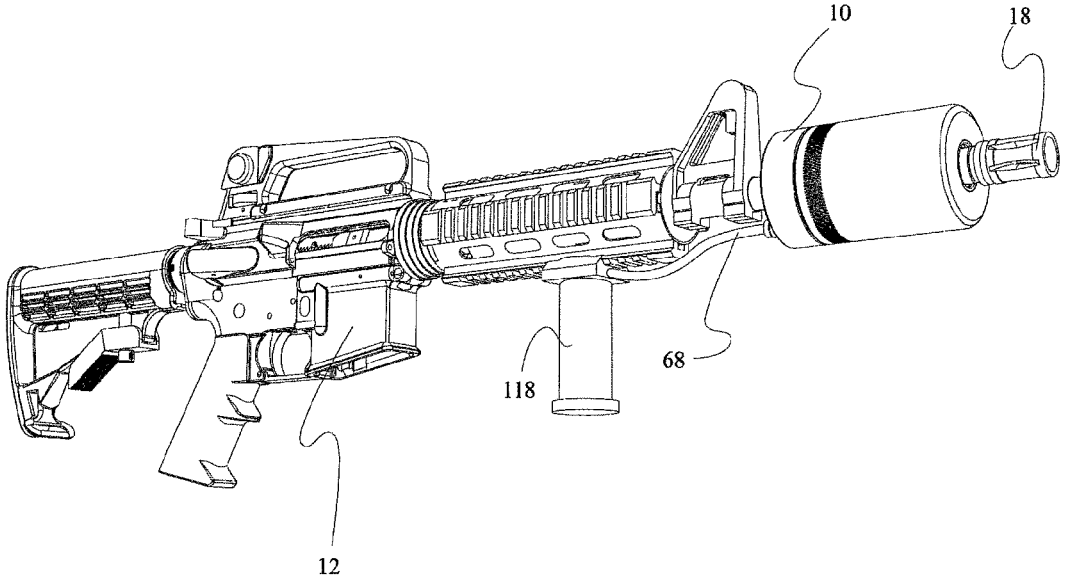
FIG. 19 illustrates another embodiment of the motorized gyroscopic weapon stabilizer as mounted by way of example to a rifle type weapon. In this embodiment, the battery case is incorporated into a hand grip attached to the rifle type weapon.

FIG. 19 illustrates another embodiment of the motorized gyroscopic weapon stabilizer 10 as mounted by way of example to a rifle type weapon 12. In this illustration, the motorized gyroscopic weapon stabilizer 10 is positioned on the barrel 14 with the flash suppressor 18 located in front of it. In this embodiment, the battery case 66 is incorporated into a hand grip 118 attached to the rifle type weapon 12. The hand grip 118 can be made in several different ways and with different materials, and designed to hold the battery or batteries 82 in many different ways with different closure methods depending on the construction of the weapon 12. In a preferred embodiment, hand grip 118 is connected to the motorized gyroscopic weapon stabilizer 10 through a power cable 68, or may be connected directly to the motorized gyroscopic weapon stabilizer 10 providing the energy needed to power the motorized gyroscopic weapon stabilizer 10. The hand grip 118 may take many forms by way of example but not limited to; as a rectangle, cylinder, square, freeform or other entity.

Figure 20:
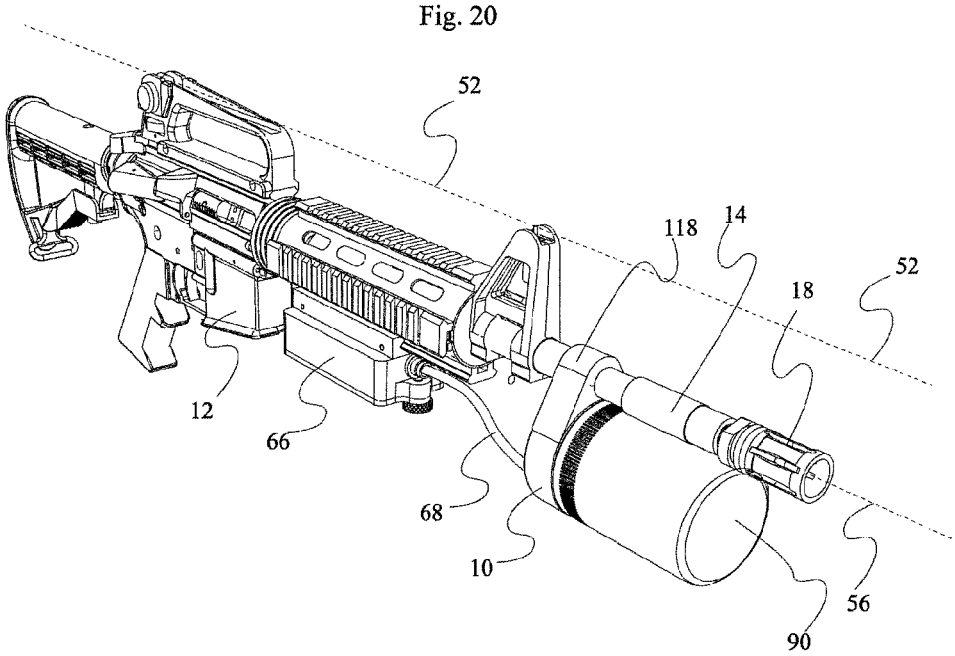
FIG. 20 illustrates another embodiment of the motorized gyroscopic weapon stabilizer by way of example mounted on the barrel but with the motorized gyroscopic weapon stabilizer having a closed end and not having the target alignment—line of sight nor the projectile passing through the open core in the motorized gyroscopic weapon stabilizer.

In FIG. 20, the barrel 14 of the rifle type weapon 12 still has a flash suppressor 18 located on the end of the barrel 14. In this illustration, the motorized gyroscopic weapon stabilizer 10 is attached to the barrel 14 by way of example but not limited to; as a mounting bracket 120 attachment method to the barrel 14. In this embodiment, the motorized gyroscopic weapon stabilizer 10 has a closed end of the gyroscopic weapon stabilizer 90 not having the target alignment—line of sight 52 nor the projectile passing through the open core in the motorized gyroscopic weapon stabilizer 56. The motorized gyroscopic weapon stabilizer 10 is attached to the battery case 66 mounted to the weapon housing—stock—hand grip 122 by the power cable 68, providing the motorized gyroscopic weapon stabilizer 10 the power to function. The battery case 66 may take many forms by way of example but not limited to; as a rectangle, cylinder, square, freeform or other entity such as a handgrip or stock.

Figure 21:
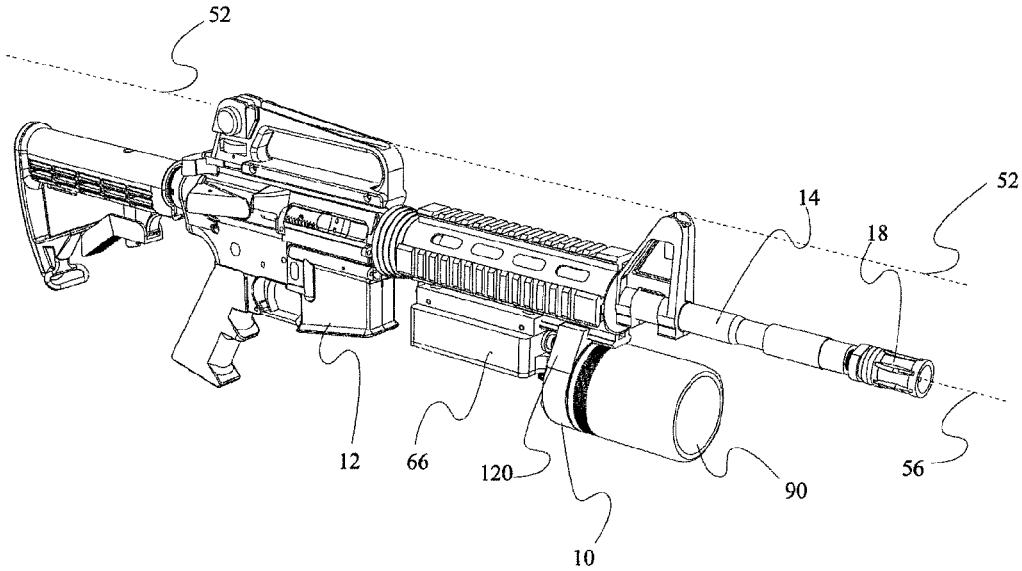
FIG. 21 illustrates another embodiment of the motorized gyroscopic weapon stabilizer by way of example mounted to the non-barrel part of the weapon with a closed end of the gyroscopic weapon stabilizer not having the target alignment—line of sight nor the projectile passing through the open core in the motorized gyroscopic weapon stabilizer.

FIG. 21 illustrates another embodiment of the motorized gyroscopic weapon stabilizer 10 as mounted by way of example to a rifle type weapon 12. In this illustration, the motorized gyroscopic weapon stabilizer 10 is positioned below the barrel 14. The barrel 14 of the rifle type weapon 12 still has a flash suppressor 18 located on the end of the barrel 14. In this illustration, the motorized gyroscopic weapon stabilizer 10 is attached by way of example, to the non-barrel part of the weapon 12. In this embodiment, the motorized gyroscopic weapon stabilizer 10 has a closed end of the gyroscopic weapon stabilizer 90 not having the target alignment—line of sight 52 nor the projectile passing through the open core in the motorized gyroscopic weapon stabilizer 56. In this illustration, the motorized gyroscopic weapon stabilizer 10 is shown attached by way of example by a mounting bracket 120 to the weapon 12. In this embodiment, the attachment system may take several forms, including but not limited to; a weaver type rail, a STANAG type rail, a picatinny type rail, a bolt- screw, a clip, a snap, a slide, a clasp, a handgrip, or any type of mounting bracket 120 designed to attach items to a rifle type weapon 12. The motorized gyroscopic weapon stabilizer 10 is attached to the battery case 66 mounted to the weapon housing—stock—handgrip 122 by the power cable 68, providing the motorized gyroscopic weapon stabilizer 10 the power to function. The battery case 66 may take many forms by way of example but not limited to; as a rectangle, cylinder, square, freeform or other entity such as a handgrip or stock.

Figure 22:
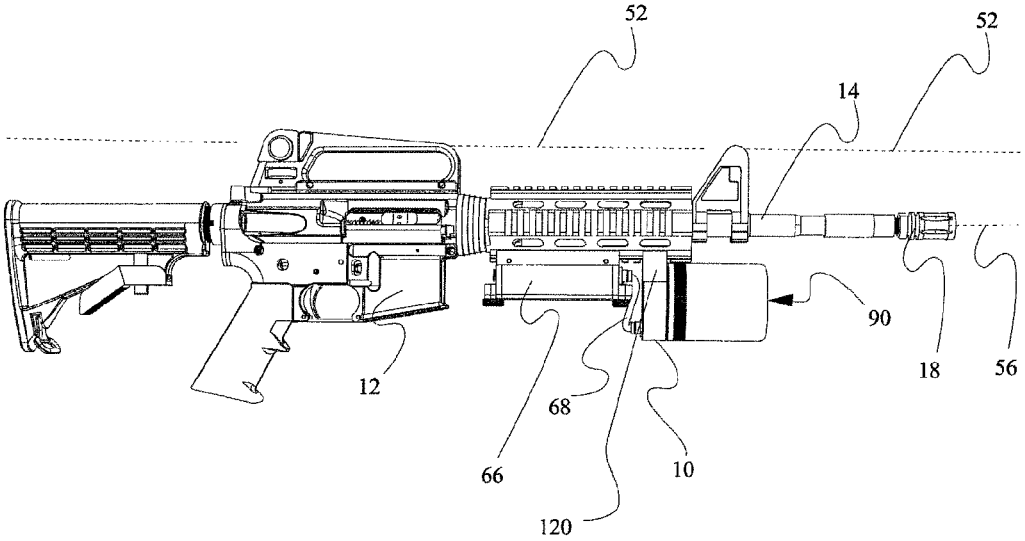
FIG. 22 shows a side view of the embodiment described in FIG. 21.

FIG. 22 shows a side view of the embodiment described in FIG. 21.

Figure 23:
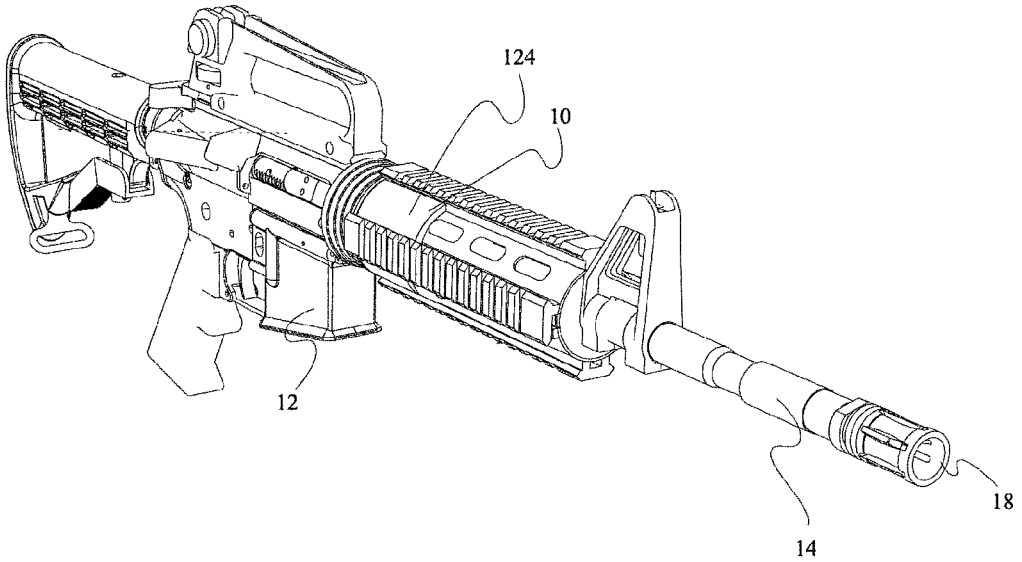
FIG. 23 illustrates another embodiment of the motorized gyroscopic weapon stabilizer by way of example incorporated into the rifle type weapon construction. In this drawing, the motorized gyroscopic weapon stabilizer is housed within the combination of a gyroscopic outer housing and the weapon housing—stock—handgrip, enclosing it within the natural form of the rifle type weapon.

FIG. 23 illustrates another embodiment of the motorized gyroscopic weapon stabilizer 10 mounted by way of example to a rifle type weapon 12. In this illustration, the motorized gyroscopic weapon stabilizer 10 is incorporated into the combination of a gyroscopic outer housing and the weapon housing—stock—handgrip 124. The motorized gyroscopic weapon stabilizer 10 is relatively hidden from view and is not secured to the barrel 14 by the affixing of the flash suppressor 18, but is instead either directly or indirectly attached to the barrel 14, or attached to the rifle type weapon 12 via another attachment method. In this embodiment, the rifle barrel 14 may by way of example form the center open core of the assembly onto which the bearings are attached. This positioning permits a less obtrusive incorporation of the device onto or into the rifle type weapon 12, and a positioning which is more centralized in relationship to the rifle type weapon 12.

Figure 24:
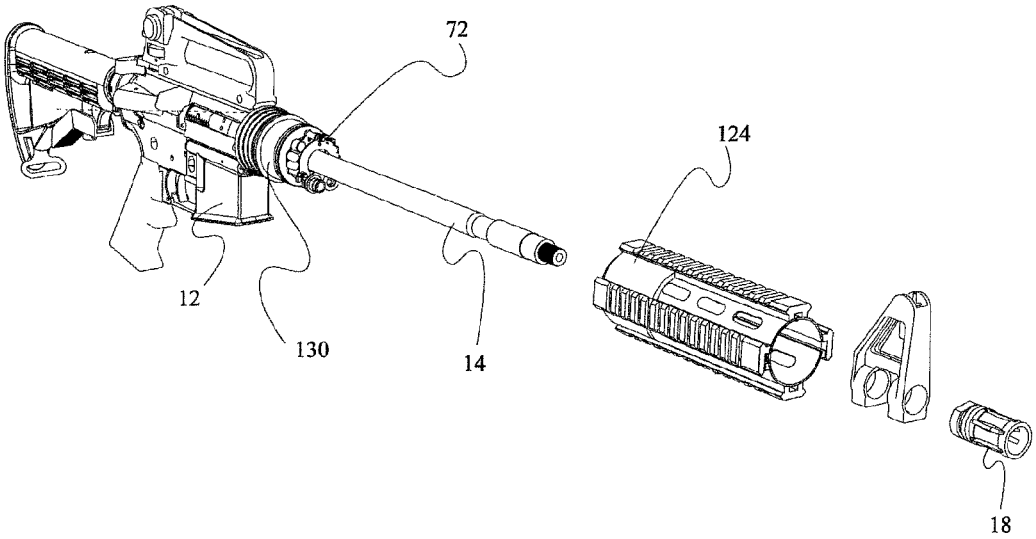
FIG. 24 is a partial exploded view of the embodiment illustrated in FIG. 23, showing the motorized gyroscopic weapon stabilizer by way of example functioning within the rifle type weapon structure.

FIG. 24 illustrated further details of the arrangement illustrated in FIG. 23. In this view, the combination of a gyroscopic outer housing and the weapon housing—stock—handgrip 124 has been removed for clarity. The rotor assembly 130 is shown attached to the rifle type weapon 12 and is by way of example either mounted directly or by another attachment method around the weapon barrel 14. The electronic power board 72 is shown by way of example mounted in front of the rotor assembly 130, although its position can be modified in its relationship to the rifle type weapon 12.

Figure 25:
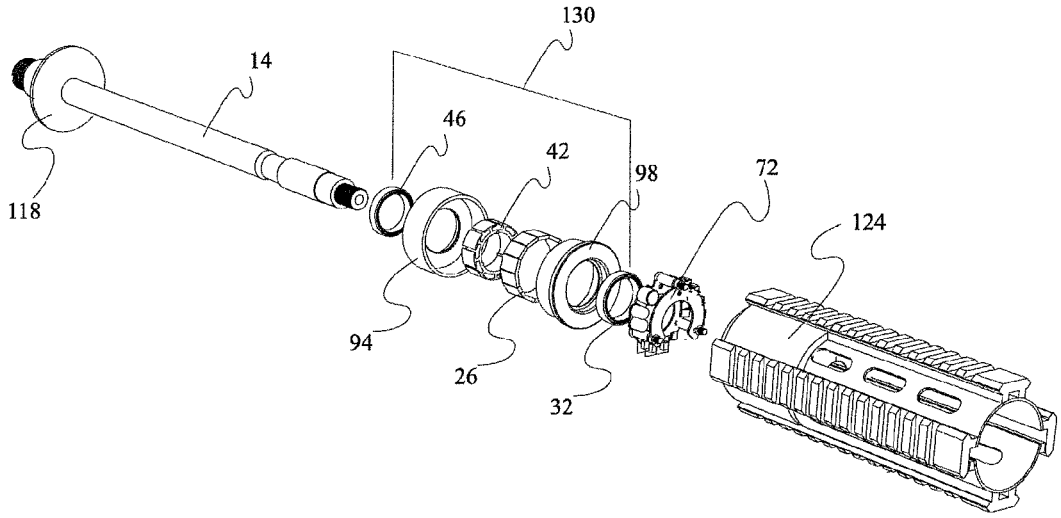
FIG. 25 shows the embodiment illustrated in FIG. 23 in a exploded view showing additional detail.

FIG. 25 is an exploded view of the rotor assembly 130 contained within the combination of a gyroscopic outer housing and the weapon housing—stock—handgrip 124. This drawing further clarifies the embodiment illustrated in FIG. 23. In this embodiment, the rear portion of motorized gyroscopic weapon stabilizer housing 118 is either incorporated into, or attached to the weapon barrel 14. The rear bearing 46 is either attached directly to or attached via bracket to the weapon barrel 14. The rear bearing 46 is attached to the rear rotor half 94 which is attached to the front rotor half 98 and the front bearing 32. The front bearing 32 is either attached directly to or attached via bracket to the weapon barrel 14. Both the stator and windings 42 and the magnets 26 which are attached to the front rotor half 98 are held inside this assembly. The electronic power board 72 is shown by way of example in front of the rotor assembly 130, but may be positioned in many different locations or attached remotely. The combination of a gyroscopic outer housing and the weapon housing—stock—handgrip 124 provides the front of the rotor assembly 130. This embodiment of the motorized gyroscopic weapon stabilizer 10 further incorporates aspects of this disclosure into the construction of the rifle type weapon 12.

Figure 26:
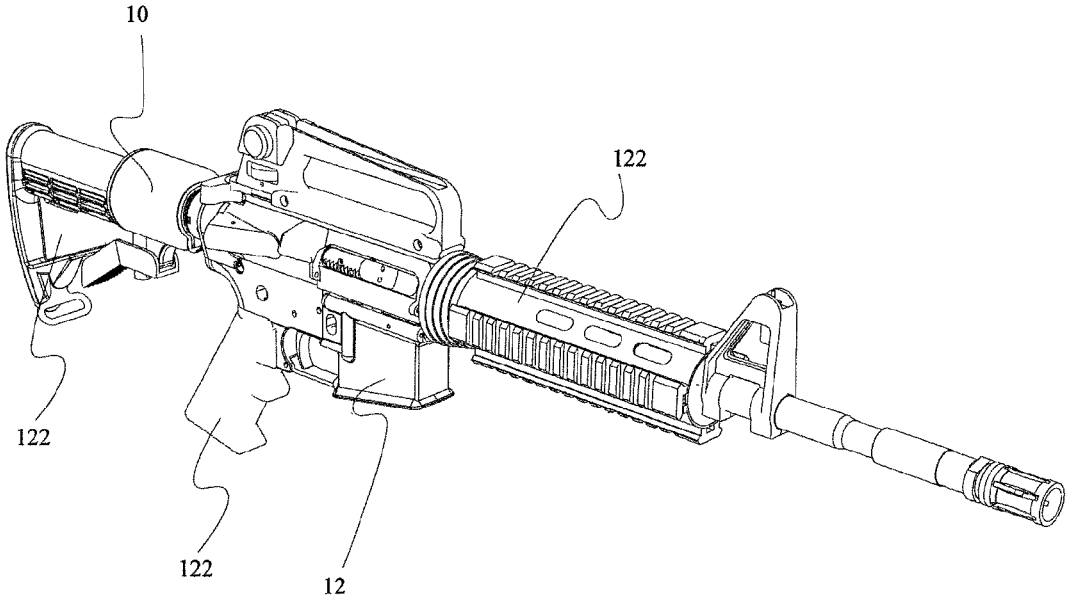
FIG. 26 illustrates the motorized gyroscopic weapon stabilizer by way of example incorporated into the rear weapon housing—stock—of a rifle type weapon. This drawing illustrates how the gyroscopic weapon stabilizer can be incorporated into the natural form of a rifle type weapon, and be either partially or fully enclosed within the natural form of the rifle type weapon.

FIG. 26 illustrates by way of example another embodiment of the motorized gyroscopic weapon stabilizer 10 as mounted onto the rifle type weapon 12. Depending on the rifle type weapon 12 style, the weapon housing—stock 122 can take many forms. In some forms, the weapon housing—stock can be made in separate pieces as shown in this illustration, but in other configurations, this weapon housing—stock 122 can be made as one combined part. In this illustration, the motorized gyroscopic weapon stabilizer 10 is incorporated into the rear portion of the weapon housing—stock 122. This rear portion of the weapon housing—stock 122 can be constructed as a separate rear component of the rifle type weapon 12, or in combination with a stock which has many parts depending on the construction of the rifle type weapon 12. The placement of the motorized gyroscopic weapon stabilizer 10 in the rear portion of the weapon housing—stock 122 can be made either visible or hidden depending on the rifle type weapon 12 construction.

Figure 27:
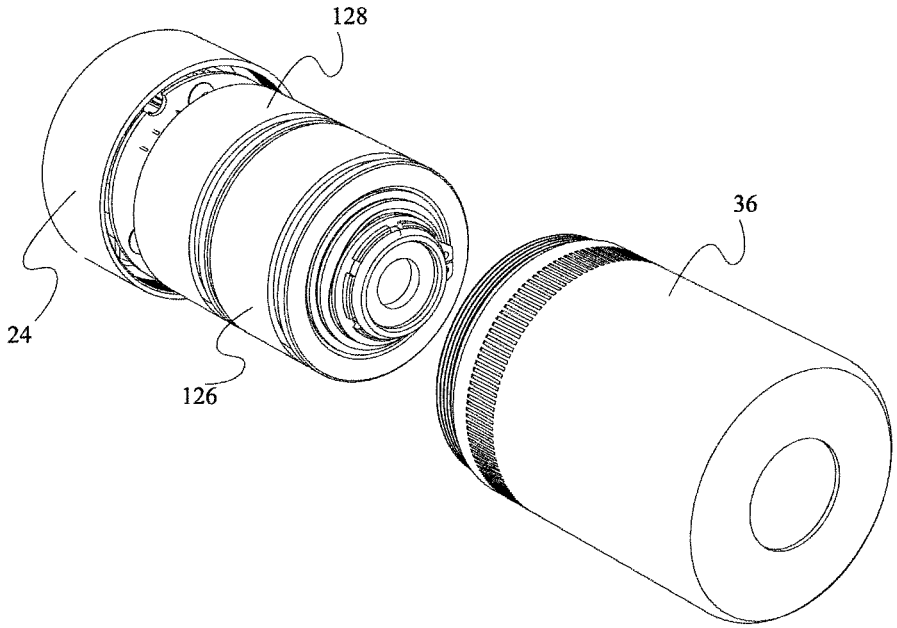
FIG. 27 illustrates another embodiment in a partially exploded view of the motorized gyroscopic weapon stabilizer where by way of example, two rotor assemblies can be incorporated into the housing with opposing directional rotation which counteracts gyroscopic precession.

FIG. 27 illustrates by way of example another embodiment of the motorized gyroscopic weapon stabilizer 10. In this drawing, the motorized gyroscopic weapon stabilizer 10 is shown to contain two separate gyroscopic rotor assemblies. This embodiment has a front rotor assembly 126 and a rear rotor assembly 128. By way of example, in this one possible assembly variation, the two rotor halves are contained within an inner housing 24 and an outer housing 36. These two rotors are designed to operate in opposing directions to eliminate the gyroscopic precession effect. This configuration of the internal rotors may be applied to any and all forms of the motorized gyroscopic weapon stabilizer 10.

Figure 28:
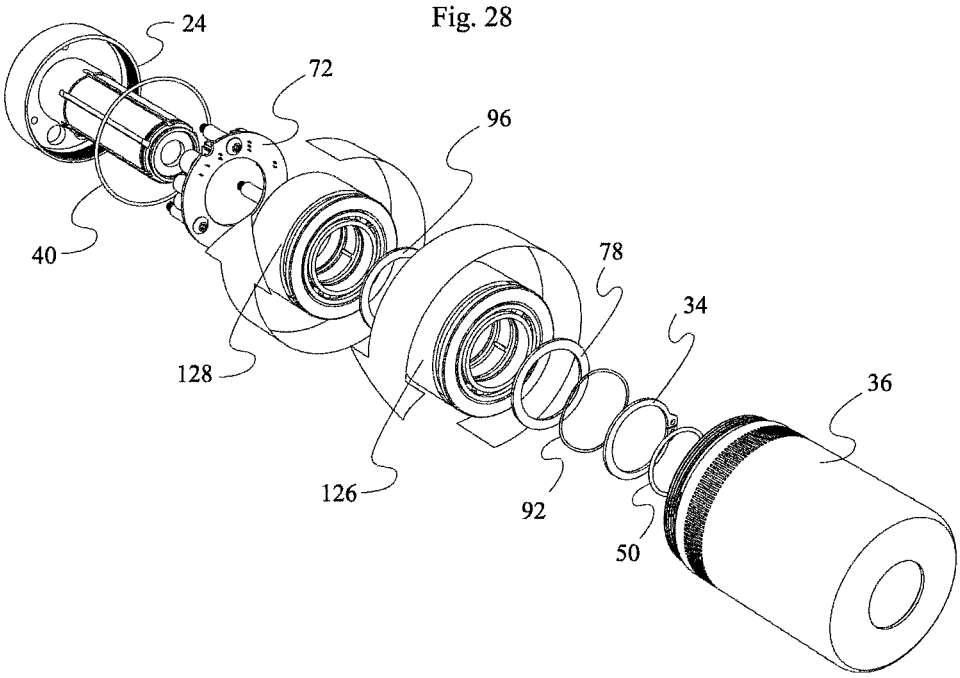
FIG. 28 is another partial exploded view of the embodiment shown in FIG. 27 showing by way of example the motorized gyroscopic weapon stabilizer with two rotor assemblies rotating in opposite directions.

FIG. 28 illustrates by way of example a clarification of the drawing in FIG. 27 as a partial exploded view of the assembly shown in FIG. 27. In this drawing, the rear ring seal 40 and front ring seal 50 seals the assembly from debris and liquids.

The two rotor assemblies are separated by spacer ring 96, and are held onto the inner housing 24 with a front ring 78, a front wavy washer 92, and front retainer 34. By way of example, the gyroscopic weapon stabilizer 10 is constructed using two gyroscopic rotors mounted onto the inner housing 24, a front rotor assembly 126, and a rear rotor assembly 128. The electronic power board 72 is configured to power the two rotor assemblies in opposing rotational directions. By doing this, the gyroscopic weapon stabilizer 10 eliminates the gyroscopic precession effect. By way of example, he entire assembly is housed within the outer housing 36.

Figure 29:
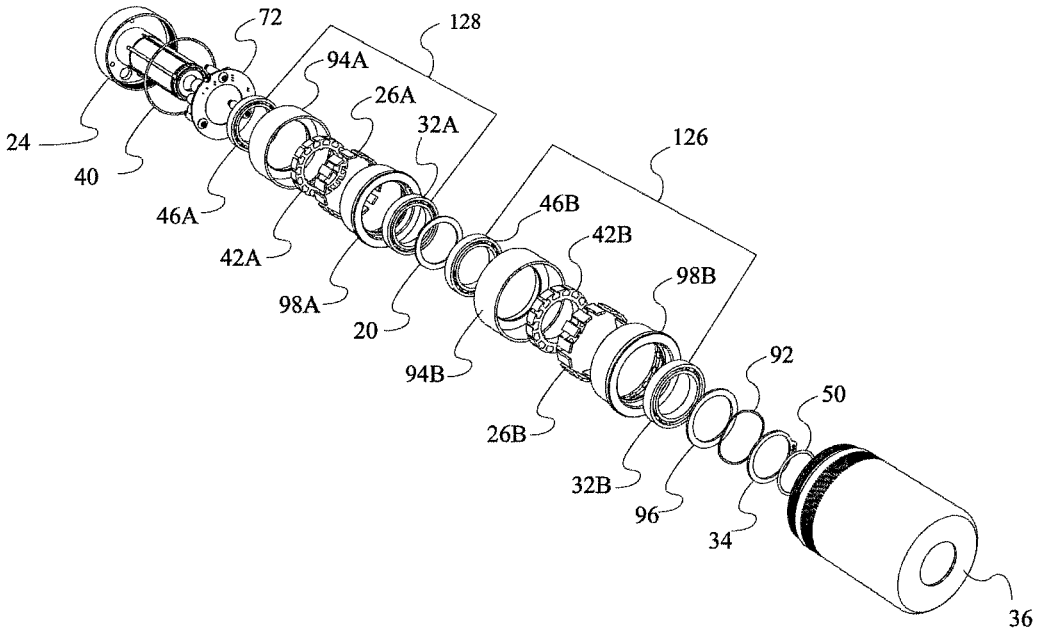
FIG. 29 shows a fully exploded view of the motorized gyroscopic stabilizer illustrated in FIG. 27.

FIG. 29 illustrates by way of example a fully exploded view of the drawing shown in FIG. 27. In this embodiment, the inner housing 24 forms the hollow core which all of the elements are attached. The electronic power board 72 may be mounted in a wide variety of places, however in this embodiment; it is attached to the inner housing 24, and powers the motorized gyroscopic weapon stabilizer 10. To form the rear rotor assembly 128, the rear bearing 46A is directly attached to the rear rotor half 94A. The rear bearing 46A rotates on the inner housing 24 outer support surface. The magnets 26A are mounted within the front rotor assembly 98A. The front bearing 32A is also mounted inside the front rotor half 98A. The front bearing 32A rotates on the inner housing 24 outer support surface. The stator and windings 42A are securely mounted to the outer bearing surface of the inner housing 24, and is enclosed within the rear rotor half 94A and the front rotor half 98A. The rear rotor half 94A and front rotor half 98A when attached together form a complete and independent rear rotor assembly 128. The rear rotor assembly 128 and front rotor assembly 126 are separated by ring 20. To form the front rotor assembly 126, the rear bearing 46B is directly attached to the rear rotor half 94B. The rear bearing 46B rotates on the inner housing 24 outer support surface. The magnets 26B are mounted within the front rotor assembly 98B. The front bearing 32B is also mounted inside the front rotor half 98B. The front bearing 32B rotates on the inner housing 24 outer support surface. The stator and windings 42B are securely mounted to the outer bearing surface of the inner housing 24, and is enclosed within the rear rotor half 94B and the front rotor half 98B. The rear rotor half 94B and front rotor half 98B when attached together form a complete and independent front rotor assembly 126. Both front rotor assembly 126 and rear rotor assembly 128 and the electronic power board 72 are housed within the outer housing 36 which when attached to the inner housing 24 creates an enclosed structure. Spacer ring 96 and front wavy washer 92 are held in position in front of front rotor assembly 126 by the attachment of front retainer 34 onto inner housing 24. The front ring seal 50 is attached to the front of the inner housing 24 to make a seal against debris and liquids. By constructing the motorized gyroscopic weapon stabilizer 10 in this fashion, the front rotor assembly 126 and the rear rotor assembly 128 are allowed to rotate in opposite directions and eliminate gyroscopic precession.

The present disclosure has been described with reference to the certain embodiments. Modifications and alterations may occur to others upon reading and understanding the preceding detailed description. It is intended that the present disclosure be constructed as including all such modifications and alterations insofar as they come within the scope of the appended claims or the equivalents thereof.

The invention claimed is:

1. A gyroscopic stabilizer system for weaponry, the system comprising:

a hollow core mass element having a bore extending therethrough mounted by at least one bearing for rotation around an axis of rotation extending through the bore;

a mounting structure configured to mount the mass element and the at least one bearing to an associated weapon such that the axis of rotation is parallel to an axis of a trajectory of a fired projectile;

a drive unit for rotating the hollow core mass element; and a power source operably connected to the drive unit for providing power to the drive unit;

wherein the mounting structure includes a tubular inner housing about which the at least one bearing is supported; and wherein the drive unit includes an electric motor, and wherein the hollow core mass element comprises a rotor portion of the electric motor and the tubular inner housing comprises an open core shaft of the electric motor.

2. The system according to claim 1, wherein the power source includes at least one battery.

3. The system according to claim 2, wherein the at least one battery is supported within a common housing with the hollow core mass.

4. The system according to claim 2, wherein the power source includes a battery mounted remote from the hollow core mass and drive unit.

5. The system according to claim 4, wherein the battery is mounted to the associated weapon in separate housing in spaced relation to the hollow core mass or mounting structure.

6. The system according to claim 5, wherein the battery is at least one of mounted to a gun rail of the associated weapon, mounted to a handgrip of the associated weapon, at least partially concealed within a handgrip of the associated weapon, or at least partially concealed within a stock of the associated weapon.

7. The system according to claim 1, further comprising an outer housing, the outer housing and inner housing being secured together, wherein the rotating mass is enclosed within the inner housing and the outer housing.

8. The system according to claim 7, wherein the inner housing are sealed together forming a watertight compartment in which the rotating mass is enclosed.

9. The system according to claim 1, wherein the rotating mass further comprises two counter-rotating gyroscopic rotors.

10. A method for stabilizing a weapon, the method comprising:

mounting a mass element by at least one bearing for rotation around an axis of rotation, the mass element having a bore extending therethrough with the axis of rotation extending through the bore;

mounting the mass element and the at least one bearing to a weapon such that the axis of rotation is parallel to an axis of a trajectory of a fired projectile, with the axis of trajectory passing through the bore; and rotating the mass element around the axis of rotation with a drive unit and a power source operably connected to the drive unit for providing power to the drive unit;

wherein the at least one bearing and the mass element are mounted to the end of a barrel of the weapon; and wherein the drive unit includes an electric motor, and wherein the mass element comprises a rotor portion of the electric motor.

11. The method of claim 10, wherein the power source includes at least one battery.

12. The method of claim 11, further comprising mounting the battery to at least one of a gun rail of the associated weapon, a handgrip of the associated weapon, at least partially concealing the battery within a handgrip of the associated weapon, or at least partially concealing the battery within a stock of the associated weapon.

13. A gyroscopic stabilizer system for weaponry, the system comprising:

a first hollow core mass element having a bore extending therethrough mounted by at least one bearing for rotation in a first rotational direction about an axis of rotation extending through the bore;

a second hollow core mass element having a bore extending therethrough mounted by at least one bearing for rotation in a second rotational direction about an axis of rotation extending through the bore;

a mounting structure configured to mount the first and second hollow core mass elements and bearings to an associated weapon such that the axis of rotation of each of the first and second hollow core masses are is parallel to an axis of a trajectory of a fired projectile;

wherein the mounting structure includes a tubular inner housing about which at least one of the bearings is supported;

and wherein the first and second hollow core masses are aligned such their respective bores define a passageway through which a line of sight extends.

14. The system according to claim 13, wherein the mounting structure supports the first and second hollow core mass elements for rotation around the trajectory of the fired projectile and/or the line of sight, and wherein the first and second hollow core mass elements are supported is spaced relation along a common axis.

15. The system according to claim 13, further including a motor which rotates the first and second hollow core mass elements around the axis of rotation.

16. The system according to claim 13, wherein the weapon is one of a single shot, semi-automatic, or fully automatic weapon.

* * * * *